US011220373B2

(12) United States Patent
Pellingra

(10) Patent No.: US 11,220,373 B2
(45) Date of Patent: Jan. 11, 2022

(54) BOTTLE POUCH WITH RIGID HANDLE

(71) Applicant: ProAmpac Intermediate, Inc., Cincinnati, OH (US)

(72) Inventor: Salvatore Pellingra, Newport, KY (US)

(73) Assignee: PROAMPAC HOLDINGS INC., Cincinnati, OH (US)

( * ) Notice: Subject to any disclaimer, the term of this patent is extended or adjusted under 35 U.S.C. 154(b) by 0 days.

(21) Appl. No.: 15/842,570

(22) Filed: Dec. 14, 2017

(65) Prior Publication Data

US 2018/0170622 A1 Jun. 21, 2018

Related U.S. Application Data

(60) Continuation-in-part of application No. 14/672,537, filed on Mar. 30, 2015, now Pat. No. 10,189,609,
(Continued)

(51) Int. Cl.
*B65D 33/06* (2006.01)
*B31B 70/81* (2017.01)
(Continued)

(52) U.S. Cl.
CPC ..... *B65D 33/06* (2013.01); *B31B 70/008* (2017.08); *B31B 70/81* (2017.08); *B31B 70/86* (2017.08);
(Continued)

(58) Field of Classification Search
CPC ..... B65D 33/06; B65D 33/02; B65D 33/065; B65D 33/08; B65D 33/12; B65D 33/1616;
(Continued)

(56) References Cited

U.S. PATENT DOCUMENTS 807,365 A * 12/1905 Eggers ..... B65D 33/06 383/25
666,275 A 9/1907 Hartmann
(Continued)

FOREIGN PATENT DOCUMENTS

CN 1953729 A 4/2007
CN 104786663 A 7/2015
(Continued)

OTHER PUBLICATIONS

International Search Report, International Application No. PCT/US2012/064605, dated Mar. 18, 2013.
(Continued)

*Primary Examiner* — Jes F Pascua
(74) *Attorney, Agent, or Firm* — McLane Middleton, Professional Association

(57) ABSTRACT

A bottle pouch with an integrated fitment and inner support handle piece includes a flexible pouch in the shape of a bottle including a flexible pouch body with a handle region, and a combined fitment and inner support handle piece including a rigid handle portion extending from the combined fitment and inner support handle piece. The combined fitment and inner support handle piece is coupled to the flexible pouch. The inner support handle piece extends from the inside of the fitment and is internal to the flexible pouch body and passes from the interior to the exterior of the flexible pouch body adjacent to the handle region of the flexible pouch body to form the rigid handle portion. In another form, the inner support handle piece extends from the outside periphery of the fitment and is external to the flexible pouch body, but is secured to the periphery of the flexible pouch body with one or more outer sleeves or loops.

26 Claims, 12 Drawing Sheets

Related U.S. Application Data which is a division of application No. 13/673,293, filed on Nov. 9, 2012, now Pat. No. 8,992,084.

(60) Provisional application No. 61/558,754, filed on Nov. 11, 2011.

(51) Int. Cl.

| | |
|---|---|
| ***B65D 75/52*** | (2006.01) |
| ***B65D 75/00*** | (2006.01) |
| ***B65B 67/12*** | (2006.01) |
| ***B65D 33/02*** | (2006.01) |
| ***B65D 33/25*** | (2006.01) |
| ***B65D 33/16*** | (2006.01) |
| ***B65D 33/12*** | (2006.01) |
| ***B65D 57/00*** | (2006.01) |
| ***B65D 75/58*** | (2006.01) |
| ***B65D 75/56*** | (2006.01) |
| ***B65B 1/02*** | (2006.01) |
| ***B65D 33/08*** | (2006.01) |
| ***B31B 70/00*** | (2017.01) |
| ***B31B 70/86*** | (2017.01) |

(52) U.S. Cl.

CPC ..... *B65B 1/02* (2013.01); *B65B 67/1238* (2013.01); *B65D 33/02* (2013.01); *B65D 33/065* (2013.01); *B65D 33/08* (2013.01); *B65D 33/12* (2013.01); *B65D 33/1616* (2013.01); *B65D 33/25* (2013.01); *B65D 57/00* (2013.01); *B65D 75/008* (2013.01); *B65D 75/52* (2013.01); *B65D 75/56* (2013.01); *B65D 75/566* (2013.01); *B65D 75/5883* (2013.01); *Y10S 383/906* (2013.01)

(58) Field of Classification Search

CPC ..... B65D 33/25; B65D 57/00; B65D 75/008; B65D 75/52; B65D 75/56; B65D 75/566; B65D 75/5883; Y10S 383/906; B31B 70/008; B31B 70/86; B31B 70/81

USPC ..... 383/12, 906

See application file for complete search history.

(56) References Cited

U.S. PATENT DOCUMENTS

| | | | | | |
|---|---|---|---|---|---|
| 2,772,821 | A | * | 12/1956 | Phillips | B65D 47/061 222/520 |
| 3,231,901 | A | * | 2/1966 | Kennedy | A61F 5/4408 604/322 |
| 3,238,984 | A | | 3/1966 | Shurtleff et al. | |
| 3,326,591 | A | * | 6/1967 | Richter | A47G 23/0258 294/32 |
| 3,343,542 | A | * | 9/1967 | Ericson | A61F 5/4405 604/325 |
| 3,384,257 | A | * | 5/1968 | Fourqurean | A61J 9/00 215/388 |
| 3,537,109 | A | | 11/1970 | Spurrier et al. | |
| 3,740,770 | A | | 6/1973 | Villari | |
| 4,312,352 | A | * | 1/1982 | Meisch | A61G 7/0503 604/322 |
| 4,509,643 | A | | 4/1985 | Rhee | |
| 4,637,934 | A | | 1/1987 | White | |
| D288,961 | S | | 3/1987 | Anderson et al. | |
| 4,898,301 | A | | 2/1990 | Schick | |
| 4,946,292 | A | | 8/1990 | Diamond et al. | |
| 4,978,025 | A | | 12/1990 | Fougeres | |
| 5,027,748 | A | | 7/1991 | Wolak | |
| 5,292,093 | A | | 3/1994 | Shumake | |
| 5,305,920 | A | | 4/1994 | Reiboldt et al. | |
| 5,423,611 | A | | 6/1995 | Sherrard | |
| 5,439,146 | A | | 8/1995 | Niss | |
| 5,615,791 | A | | 4/1997 | Vatelot et al. | |
| 5,964,533 | A | | 10/1999 | Ziglar | |
| 6,105,821 | A | | 8/2000 | Christine et al. | |
| 6,923,574 | B2 | | 8/2005 | Siegel | |
| 6,991,121 | B1 | | 1/2006 | Kipperman et al. | |
| 7,159,742 | B2 | | 1/2007 | Lee | |
| 7,395,947 | B2 | | 7/2008 | Drennow | |
| 8,992,084 | B2 | * | 3/2015 | Pellingra | B65D 33/065 383/12 |
| 9,387,684 | B2 | | 7/2016 | Ogawa et al. | |
| 10,189,609 | B2 | * | 1/2019 | Pellingra | B65D 33/065 |
| 2002/0117514 | A1 | | 8/2002 | Allanson et al. | |
| 2003/0094464 | A1 | | 5/2003 | Decottignies | |
| 2003/0183639 | A1 | | 10/2003 | Winckels | |
| 2005/0236428 | A1 | * | 10/2005 | Quigley | A45F 3/20 222/107 |
| 2007/0051746 | A1 | | 3/2007 | De Laforcade | |
| 2007/0221607 | A1 | | 9/2007 | Piccioli et al. | |
| 2011/0044567 | A1 | | 2/2011 | Barbaroux et al. | |
| 2012/0125947 | A1 | | 5/2012 | Becker et al. | |
| 2014/0312063 | A1 | * | 10/2014 | Owensby | B65D 83/38 222/105 |

FOREIGN PATENT DOCUMENTS

| | | | | | |
|---|---|---|---|---|---|
| FR | 2698620 | A1 | | 6/1994 | |
| FR | 2890380 | A1 | * | 3/2007 | B65D 75/5883 |
| GB | 802292 | | | 10/1958 | |
| GB | 2305906 | | | 4/1997 | |
| GB | 2503750 | B | | 6/2014 | |
| JP | 10273165 | A | * | 10/1998 | |
| JP | 10324349 | A | * | 12/1998 | B65D 75/5883 |
| JP | 11079188 | A | * | 3/1999 | |
| JP | 3080159 | U | * | 9/2001 | |
| JP | 2005239237 | A | * | 9/2005 | |
| JP | 2010083562 | | | 4/2010 | |
| JP | 2011025950 | A | * | 2/2011 | |
| JP | 2002225885 | A | | 8/2012 | |
| WO | 9222234 | | | 12/1992 | |
| WO | 9316928 | | | 9/1993 | |
| WO | 2010069428 | A1 | | 6/2010 | |
| WO | 2013071220 | A1 | | 5/2013 | |

OTHER PUBLICATIONS

Machine translation of Japanese Patent Application Publication No. JP2002225885 (Aug. 14, 2012).

Machine translation of French Patent Application Publication No. FR2698620 (Jun. 3, 1994).

English machine translation of Chinese Patent Application Publication No. CN1953729A (Apr. 25, 2007).

English machine translation of Chinese Patent Application Publication No. CN104786663 (Jul. 22, 2015).

English machine translation of International Publication No. WO2010/069428A1 (Jun. 24, 2010).

* cited by examiner

BOTTLE POUCH WITH RIGID HANDLE

CROSS-REFERENCE TO RELATED APPLICATIONS

This application is a continuation-in-part of U.S. Non-provisional patent application Ser. No. 14/672,537 filed on Mar. 30, 2015, which is a divisional of U.S. Non-provisional patent application Ser. No. 13/673,293, filed Nov. 9, 2012 (now U.S. Pat. No. 8,992,084), which claims priority from and benefit of U.S. Provisional Application No. 61/558,754, filed Nov. 11, 2011, the disclosures of which are incorporated herein by reference in their entireties.

BACKGROUND

1. Field

The present disclosure relates to a system for flexible pouches with fitments, more particularly, to flexible pouches having fitments with integrated handles and internal supports. More particularly, it relates to bottle pouches with rigid handles integrated into the fitment of the pouch.

2. Brief Description of Related Developments

Generally, rigid containers are often used to handle liquid or flowable contents. However, it is also possible to use pouches with handles. However, pouches with handles often are difficult to manufacture or produce. In addition, current flexible pouches with handles are difficult to display and use because the pouches lack support.

For instance, existing pouches with handles typically are the result of die cutting and heat sealing of films—for instance, where a handle is cut directly into a pouch material and heat sealed. However, these pouch handles are often not stiff or rigid enough and are difficult to handle. Handling of such pouches may result in deformation of the shape of the pouch as well as the handle. In other types of die-cut and heat sealed handles for pouches, the handles may lose stiffness as the contents of the pouches are reduced, where the contents are no longer able to provide the necessary means to maintain the stiffened pouch handle. Other pouches with handles attempt to solve the problem by using a rigid handle piece completely external to the pouch itself. However, such pouches are often not ergonomic and difficult to handle. For instance, the handling of such pouches may be very different from how one would handle a rigid container with a handle, which may be difficult for a consumer to use. Such designs may result in more spillage or accidents during handling as the pouch deforms in unexpected ways. Yet other pouches with handles are formed with air bladders formed to be used as handles. For instance, such pouches may be formed by creating an empty space within the pouch that can be filled with air to create a handle. While such a pouch handle may be capable of retaining its shape and stiffness, this is often extremely expensive and difficult to manufacture, often requiring new or specialized equipment. It is desirable to have a pouch with a handle which avoids one or more of the aforementioned disadvantages.

Pouches, especially pouches where a structural shape is important, also are often made of a rigid, stiff material. Such rigid, stiff pouches are often important for retention of a shape or structure. However, such pouches also contribute to excess cost in manufacturing, transporting, handling, and disposing. It is desirable to have a pouch which retains its shape and structural rigidity without resorting to use of rigid, stiff materials to maintain its shape, allowing for lighter weight pouches which are easier to manufacture, handle and transport.

SUMMARY

This disclosure relates in part to a bottle pouch with an integrated fitment and inner support handle piece comprising: a flexible pouch in the shape of a bottle comprising a flexible pouch body with a handle region and a combined fitment and inner support handle piece including a rigid handle portion extending from the combined fitment and inner support handle piece. The combined fitment and inner support handle piece is coupled to the flexible pouch and the inner support handle piece extends from the inside of the fitment and is internal to the flexible pouch body. The inner support handle piece passes from the interior of the flexible pouch body to the exterior of the flexible pouch body adjacent to the handle region of the flexible pouch body to form the rigid handle portion that increases the rigidity of the handle region of the flexible pouch.

This disclosure also relates to a bottle pouch with an integrated fitment and inner support handle piece comprising: a flexible pouch in the shape of a bottle comprising a flexible pouch body with a handle region and at least one outer sleeve or loop coupled to an outer periphery of the flexible pouch body and a combined fitment and inner support handle piece including a rigid handle portion extending from the combined fitment and inner support handle piece. The combined fitment and inner support handle piece is coupled to the flexible pouch and the inner support handle piece passes through the interior of the at least one outer sleeve or loop. The inner support handle piece extends from the outer periphery of the fitment and is external to the flexible pouch body. The inner support handle piece passes from the interior of the outer sleeve or loop to the exterior of the flexible pouch body adjacent to the handle region of the flexible pouch body to form the rigid handle portion that increases the rigidity of the handle region of the flexible pouch.

This disclosure still also relates to a method of making a bottle pouch with an integrated fitment and inner support handle piece comprising the steps of: providing a flexible pouch in the shape of a bottle comprising i) a flexible pouch body with a handle region, and ii) a combined fitment and inner support handle piece including a rigid handle portion extending from the combined fitment and inner support handle piece, then coupling the combined fitment and inner support handle piece to the flexible pouch, wherein the inner support handle piece extends from the inside of the fitment and is internal to the flexible pouch body, and passing the inner support handle piece from the interior of the flexible pouch body to the exterior of the flexible pouch body adjacent to the handle region of the flexible pouch body to form the rigid handle portion that increases the rigidity of the handle region of the flexible pouch.

This disclosure still also relates to a method of making a bottle pouch with an integrated fitment and inner support handle piece comprising the steps of: providing a flexible pouch in the shape of a bottle comprising i) a flexible pouch body with a handle region and at least one outer sleeve or loop coupled to an outer periphery of the flexible pouch body, and ii) a combined fitment and inner support handle piece including a rigid handle portion extending from the combined fitment and inner support handle piece, wherein the inner support handle piece extends from the outer periphery of the fitment, then coupling the combined fitment and inner support handle piece to the flexible pouch, then passing the inner support handle piece through the interior of the at least one outer sleeve or loop and is external to the flexible pouch body, and passing the inner support handle piece from the interior of the outer sleeve or loop to the exterior of the flexible pouch body adjacent to the handle region of the flexible pouch body to form the rigid handle portion that increases the rigidity of the handle region of the flexible pouch.

BRIEF DESCRIPTION OF THE DRAWINGS

The foregoing aspects and other features of the present disclosed embodiment are explained in the following description, taken in connection with the accompanying drawings, wherein.

DETAILED DESCRIPTION OF THE EXEMPLARY EMBODIMENTS

Figure 2:
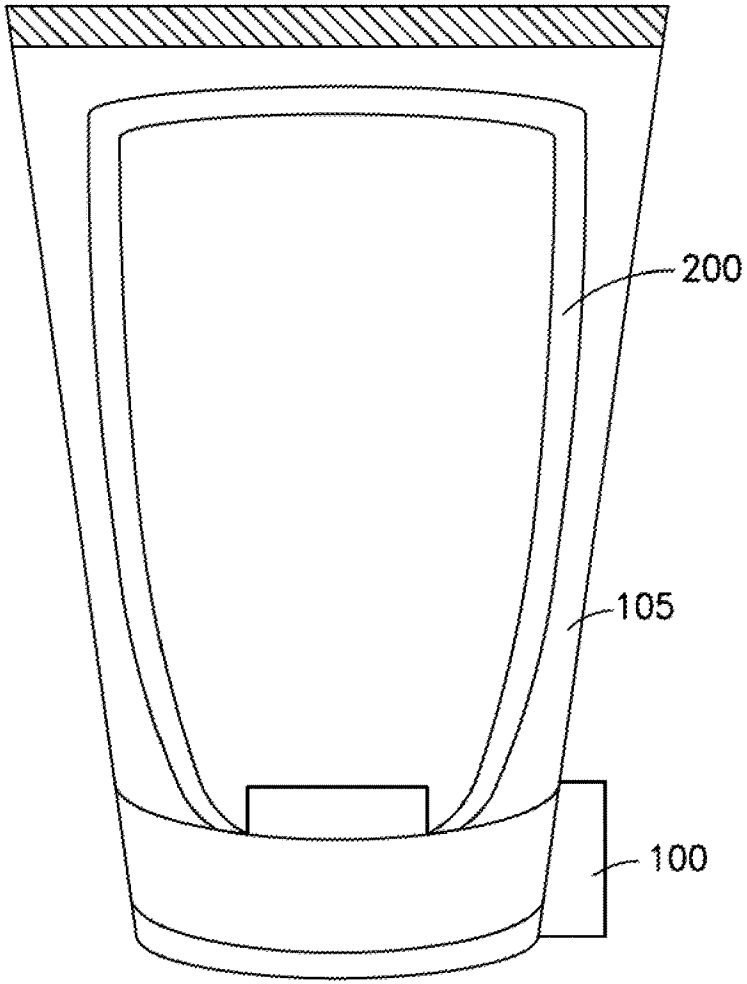
FIG. 2 is a cutaway schematic view of an exemplary pouch in view of an aspect of the exemplary embodiment.

Although the present invention will be described with reference to the embodiments shown in the drawings, it should be understood that the present exemplary embodiments can be used individually or in any suitable combination thereof. Although the aspects of the disclosed embodiments will be described with reference to the drawings, it should be understood that the aspects of the disclosed embodiment can be embodied in many alternate forms. In addition, any suitable size, shape or type of elements or materials could be used.

Figure 1:
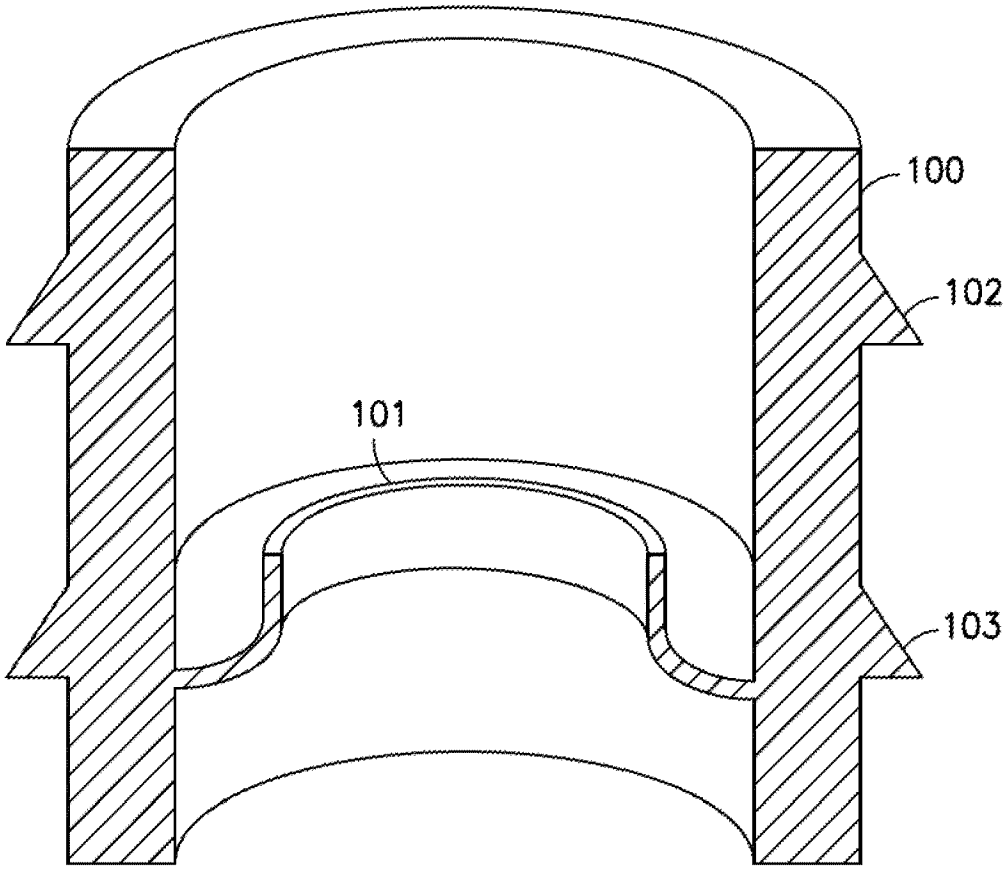
FIG. 1 is a cutaway schematic view of a fitment in view of an aspect of the exemplary embodiment.

FIG. 1 illustrates an exemplary cutaway schematic of a fitment 100. As may be seen in FIG. 1, fitment 100 may be a substantially annular or cylindrical shape in one aspect of the disclosed embodiment. However, in alternate aspects of the disclose embodiment, fitment 100 may be of any suitable fitment shape, including oval or rectangular shapes. Generally, the shape of the fitment 100 is not important, although for ease of understanding, fitment 100 will be described as an annular fitment, as seen in FIG. 1. Generally, a fitment 100 may be formed from a rigid material or any other semi-rigid, flexible or elastic support material rigid enough to maintain structural support. More particularly, the fitment material is equal to or greater in stiffness relative to the flexible pouch body. Alternatively, the fitment material is greater in stiffness relative to the flexible pouch body. Still alternatively, the fitment material is greater in stiffness relative to the flexible pouch body by at least 5%, or at least 10%, or at least 15%, or at least 20%, or at least 25%, or at least 30%, or at least 40%, or at least 50%.

In one aspect, fitment 100 may be molded of any suitably rigid material, including high density polyethylene (HDPE), polypropylene (PP), molded pulp, wood, or any other similar suitable material. In alternate aspects of the disclosed embodiment, the fitment 100 may be formed from any suitable rigid material, including metal, glass, ceramics, wood or anything which is rigid enough to maintain the shape of the fitment. As may be seen, fitment 100 may have engagement features 102, 103. Engagement features 102, 103 may be configured to engage a cap (not shown) or other form of closure for fitment 100. In other aspects, engagement features 102, 103 may engage anything which may be configured to engage with the fitment.

Referring still to FIG. 1, fitment 100 may also have an inner engagement feature 101. As may be seen in FIG. 1, the inner engagement feature 101 may be, for instance, an inner lip which substantially runs around the inside of the fitment 100 such that it is able to engage with a handle engagement feature 104, which will be described in further detail below. In alternate aspects of the disclosed embodiment, the inner engagement feature 101 may be any other suitable means for engaging with a handle engagement feature. For example, in one aspect, the inner engagement feature 101 may be a clip, or a clasp, or a friction-held engagement part. In other aspects, the inner engagement feature 101 may be any suitable means for engaging a handle engagement feature. The inner engagement feature 101 may be molded directly with fitment 100, but in other aspects, may be a separate portion which is joined to the fitment 100 by some other means.

Figure 1A:
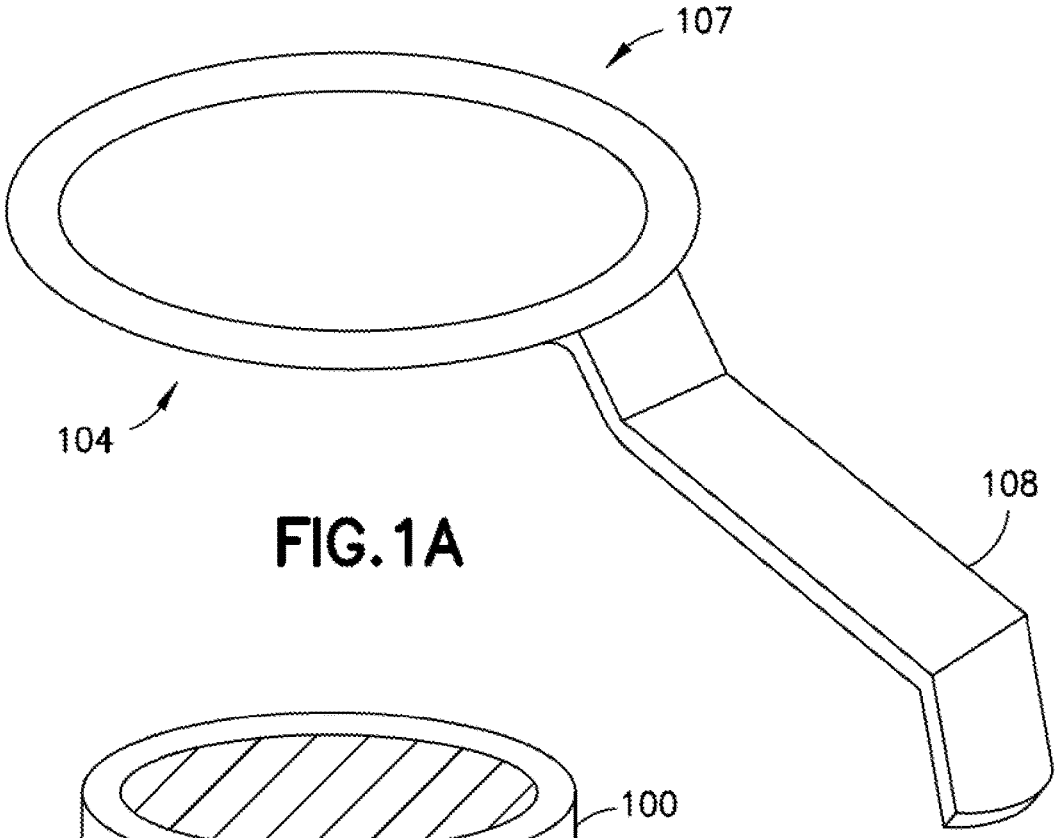
FIG. 1A is a perspective view of a handle piece in view of an aspect of the exemplary embodiment.

Referring now to FIG. 1A, a perspective view diagram of a handle piece 107 is shown. The handle piece 107 may be molded or otherwise formed from a rigid material or any other semi-rigid, flexible or elastic support material rigid enough to maintain structural support. More particularly, the handle piece material is equal to or greater in stiffness relative to the flexible pouch body. Alternatively, the handle piece material is greater in stiffness relative to the flexible pouch body. Still alternatively, the handle piece material is greater in stiffness relative to the flexible pouch body by at least 5%, or at least 10%, or at least 15%, or at least 20%, or at least 25%, or at least 30%, or at least 40%, or at least 50%.

In one aspect, the handle piece material may be HDPE, PP, molded pulp, wood or any other similar materials. However, in other aspects, the material may be any rigid material, including metal, glass, ceramics, wood or any other suitable material rigid enough to maintain its shape. It is noted that the material of the handle piece 107 may be of the same type as the material of fitment 100, but in some aspects, the fitment 100 and handle piece 107 may utilize different materials in their formation.

Referring still to FIG. 1A, the handle piece 107 may have a handle engagement feature 104. As noted above, the handle engagement feature 104 may be substantially coupled with the inner engagement feature 101 of fitment 100 so that, when engaged, the handle piece 107 and fitment 100 become substantially one piece. As can be seen in FIG. 1A, the handle engagement feature 104 is shown to be a substantially ring-shaped engagement feature so as to couple with the inner engagement feature 101 of the annular fitment 100 shown in FIG. 1. However, in alternate aspects, the handle engagement feature 104 may be any may be any sort of suitable engagement feature which complements the inner engagement feature 101. For example, this may include, but is not limited to, a clip, a clasp, or some sort of friction-held engagement feature or any other suitable engagement feature. Though the handle engagement feature 104 is shown as a closed curved section, in alternate aspects of the disclosed embodiments, the handle engagement feature 104 may also be an open sections or any other suitable shape. In one aspect, the handle engagement feature 104 and inner engagement feature 101 may be configured so that the handle engagement feature 104 can lock into the inner engagement feature with minimal force, but afterwards, the locked in such a way that it is difficult to separate the handle engagement feature 104 from the inner engagement feature 101. Handle piece 107 may also have a handle portion 108 which is of unitary construction with the handle engagement feature 104. In one aspect, the handle portion 108 may be in substantially the shape shown in FIG. 1A, but in alternate aspects, the handle portion 108 may take any suitable shape desirable for use as a handle.

Figure 1B:
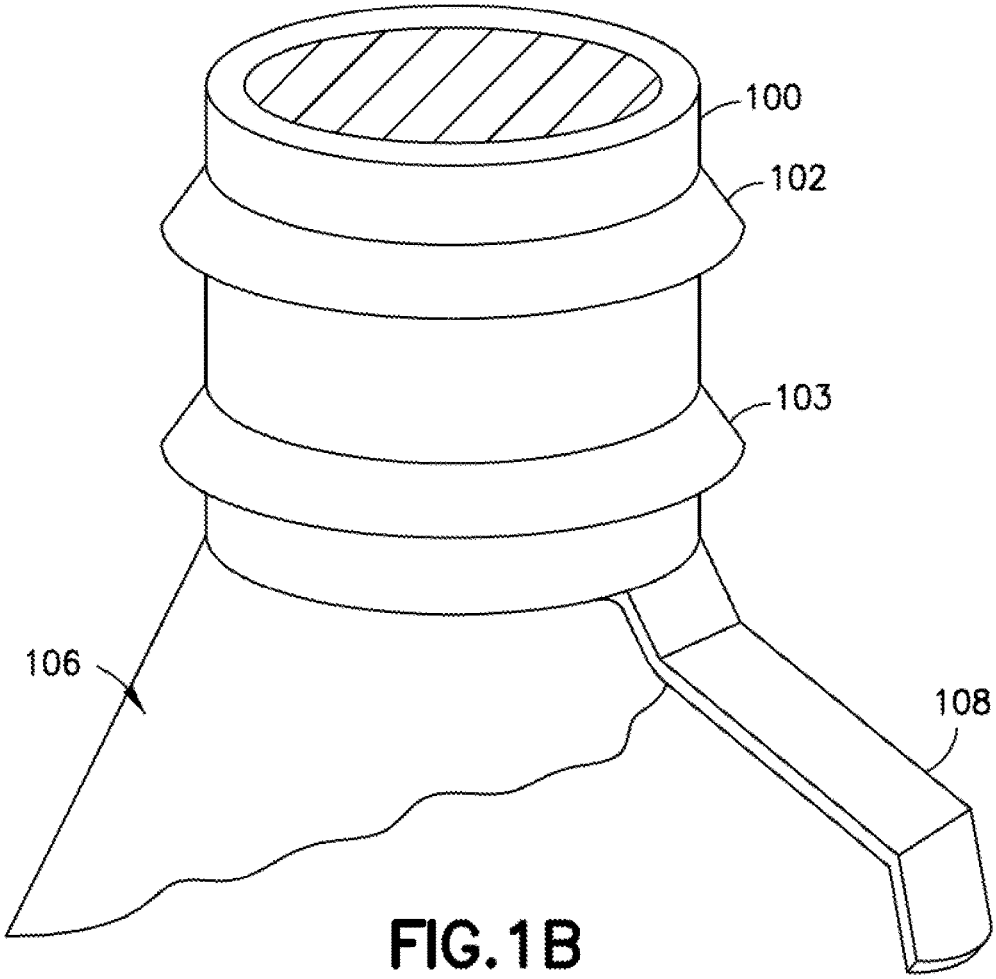
FIG. 1B is a perspective view of a combined fitment and handle piece in view of an aspect of the exemplary embodiment.

Referring now to FIG. 1B, a diagram of the combined fitment and handle piece 100 is shown. As may be understood, the combined fitment and handle piece 100 may be coupled by means of the inner engagement feature 102 and handle engagement feature 103 as described previously. In another aspect, the combined fitment and handle piece 100 is a unitary piece which does not require coupling of an inner engagement feature 102 and a handle engagement feature 103. As can be seen, the joining of combined fitment and handle piece 100 may be accomplished where the handle piece is essentially passed through the center of the fitment so that the handle portion 108 extends from the bottom of fitment 100. Fitment 100 is further attached to a preformed pouch 106 which may be formed so that the preformed pouch 106 extends from the interior of the fitment 100. In alternate aspects, the preformed pouch 106 may also be formed in any other suitable way and may be connected to the fitment 100 by any other suitable means. The preformed pouch 106 may be of any variety or type of pouch in any suitable configuration. In one aspect, the preformed pouch 106 may be formed of a flexible film or any suitable thin-gauged material suitable to be used for a flexible pouch. For example, the pouch may be formed of polypropylene in one aspect, but in other aspect, any suitable materials may be used. The preformed pouch 106 may be heat-sealed to fitment 100. In alternate aspects, the preformed pouch 106 may be attached to the fitment 100 by any suitable means. The handle portion 108 of handle piece 107 may extend into the interior of preformed pouch 106. In alternate aspects, the handle portion 108 may also extend to the exterior of the preformed pouch 106. The pouch 106 may be heat-sealed or otherwise sealed around the handle portion 108 in such a configuration. In yet alternate aspects, any suitable configuration of the handle may be possible.

Referring now to FIG. 2, a side cutaway view of a preformed pouch 106 is shown. The pouch 106 shown is in the form of a standup pouch, but in alternate aspects, any suitable pouch configuration may be used. A rigid support 200 is disposed within the preformed pouch 106. The rigid support 200 may provide support for the structure of the preformed pouch 106 so that the preformed pouch 106 may hold a predetermined structure and shape. The rigid supports 200 may also allow for a thin-gauged material to be used for the preformed pouch 106. Thin gauged material may be desirable for transportation, disposal and handling purposes, but may not be rigid or thick enough to maintain a shape or a structure by itself. The rigid supports 200 may be of any suitable material, including HDPE, PP, metal, wood or any other flexible or elastic support material rigid enough to maintain a structural shape within a pouch. More particularly, the rigid support material is equal to or greater in stiffness relative to the flexible pouch body. Alternatively, the rigid support material is greater in stiffness relative to the flexible pouch body. Still alternatively, the rigid support material is greater in stiffness relative to the flexible pouch body by at least 5%, or at least 10%, or at least 15%, or at least 20%, or at least 25%, or at least 30%, or at least 40%, or at least 50%.

The rigid support 200 may be inserted through fitment 100 into body of the preformed pouch 106. In one aspect, the rigid supports 200 may be coupled or attached to the fitment 100 so that it allows for the preformed pouch to maintain its shape during transport. For example, the rigid supports 200 may be coupled with fitment 100 through means of a clip, clasp, friction coupling features or any other suitable coupling feature.

Figure 2A:
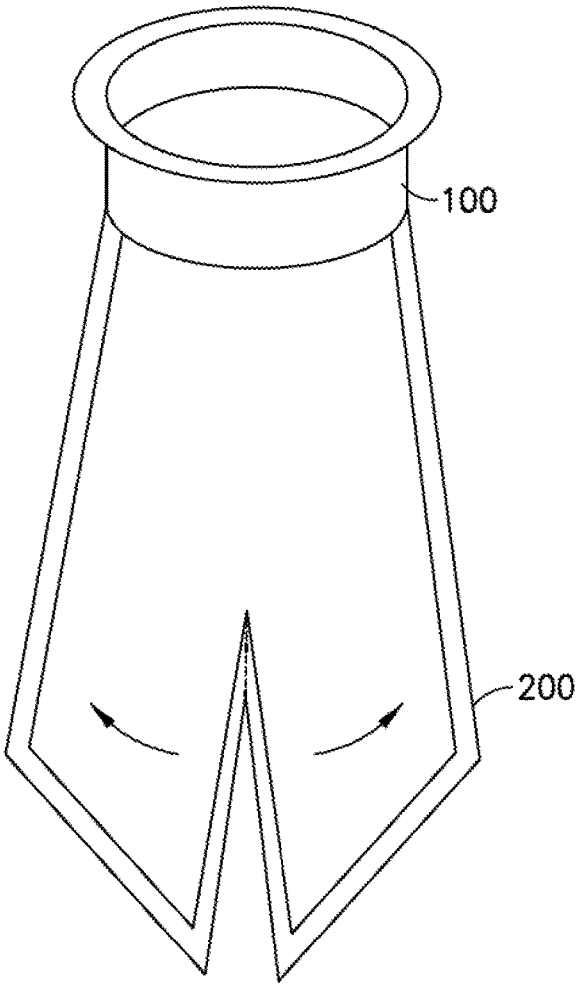
FIG. 2A is a schematic view of an internal support in view of an aspect of the exemplary embodiment.

Referring now to FIG. 2A, a side schematic view of a rigid support 200*a* is shown. The rigid support 200*a* as shown in FIG. 2A is the rigid support 200 in a compressed state. Rigid supports 200 may be configured so that it facilitates easy installation within a pouch. For instance, rigid supports 200 may be initially in a compressed state or compact state as seen in FIG. 2A. The compressed rigid supports 200*a* may facilitate installation so that it allows for easy insertion through a fitment 100, which may be narrower or smaller than an uncompressed rigid support 200 is wide. Compression of the rigid support 200 may be done by any suitable means of compacting or compressing the rigid support 200. The rigid support 200 may be compressible to a compact state by any suitable means, including springs, tension or any other suitable means.

Figure 2B:
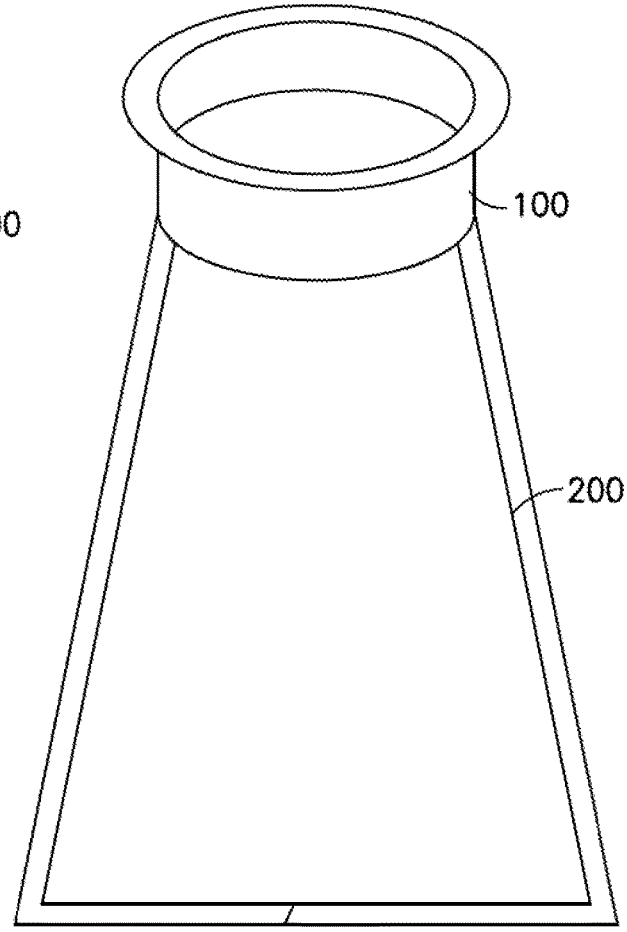
FIG. 2B is a schematic view of an internal support in view of an aspect of the exemplary embodiment.

Referring now to FIG. 2B, a side schematic view of a rigid support 200 in an uncompressed state is shown. As may be seen, the rigid support 200 may change shape or return to its original shape after installation within the pouch (for example, by insertion through a fitment 100). The rigid support 200 may be configured to change shape by any suitable mechanism, including, for example, springs, tension, or any other means. In one aspect, the absence of compression force on rigid support 200 may release tension on the rigid supports 200, allowing the rigid supports 200 to return to an uncompressed shape. This may be, for instance, by means of the elastic nature of the materials used to form the rigid supports 200. In one aspect, the changing of the shape of the rigid support 200 may be done with little or no outside applied force—i.e. the rigid support 200 may change its shape under its own impetus. However, in alternate aspects, any other suitable means for changing the shape of rigid supports 200 may be used.

Figure 3B:
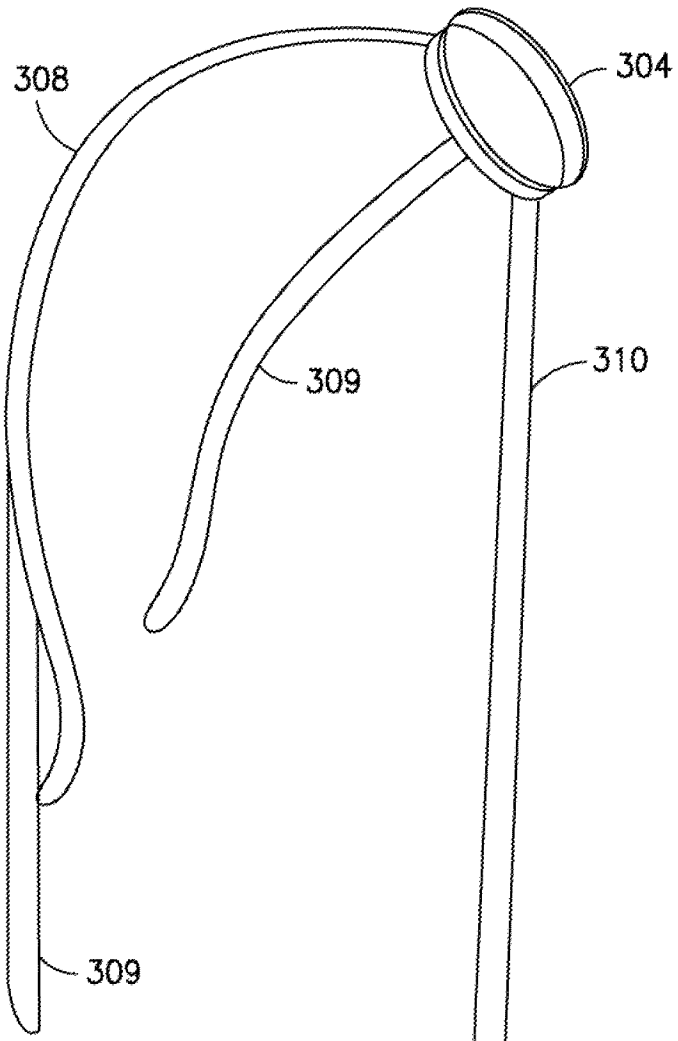
FIG. 3B is a schematic view of an exemplary internal support for the handle region and edge of a pouch in the expanded position in view of an aspect of an exemplary embodiment.
Figure 3A:
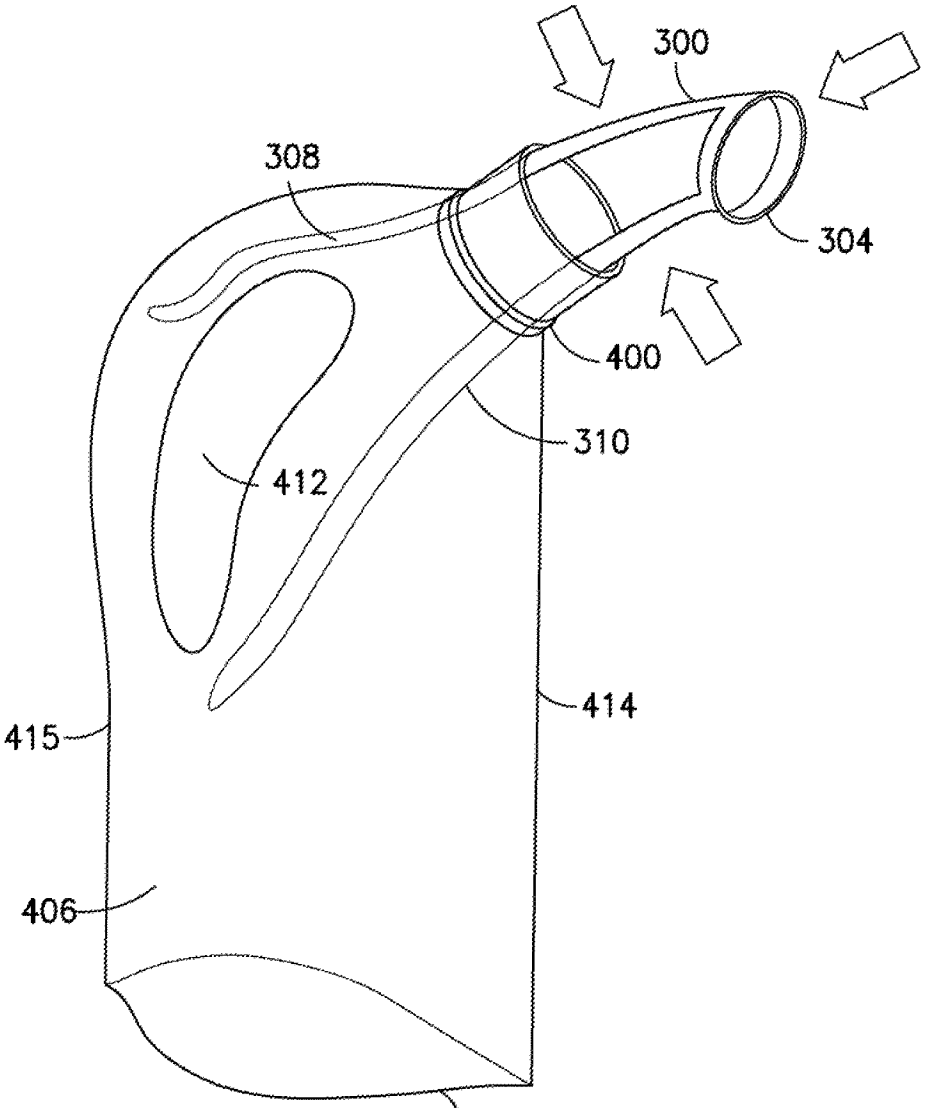
FIG. 3A is a schematic view of an exemplary pouch with an internal support being positioned into the fitment of the pouch in view of an aspect of an exemplary embodiment.
Figure 3:
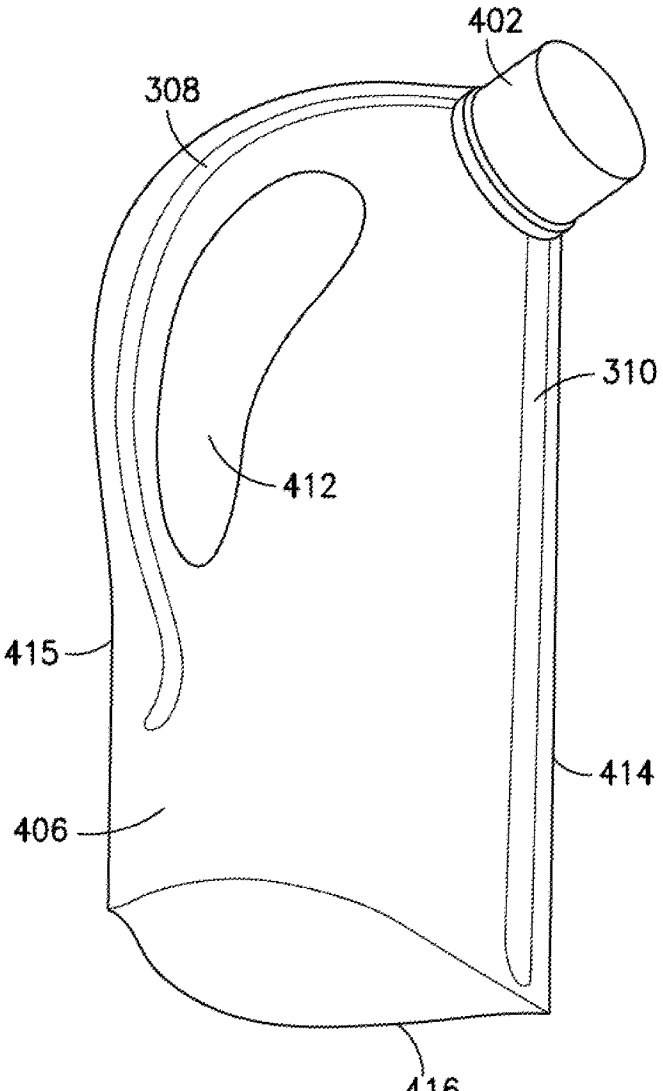
FIG. 3 is a schematic view of an exemplary pouch with an internal support for the handle and an edge in view of an aspect of an exemplary embodiment.

Referring now to FIG. 3, a schematic view of an exemplary bottle pouch 406 with a rigid internal support 300 for the handle region 412 and a front edge 414 is depicted. The bottle pouch 406 includes a fitment 400 for dispensing the contents (not shown) of the bottle pouch 406. The fitment 400 may also include a cap 402 for sealing the contents of the bottle pouch 406. The bottle pouch 406 also includes edge sections 414, 415 as well as a bottom section 416. The bottle pouch 406 may be of any suitable shape for dispensing either solid or liquid contents with the handle 412 functioning to ease the pouring of the bottle pouch 406 contents. Because the bottle pouch 406 is made of a flexible type material, it is generally flimsy, and hence difficult to dispense the liquid or solid contents, and in particular as the remaining contents of the bottle pouch 406 decrease in volume. Hence a rigid internal support 300 is inserted into the bottle pouch 406 to increase its rigidity and improve ease of handling in certain portions of the bottle pouch 406. The exemplary rigid internal support 300 in FIG. 3 includes an engagement feature 304 in its expanded position that locks into the fitment 400 of the bottle pouch 406, a handle portion 308 and a front edge portion 310. The exemplary rigid internal support 300 is internal to the bottle pouch 406 and increases the rigidity in the handle region 412 and the front edge 414 to ease handling of the pouch 406 and the pouring of its contents. The rigid internal support 300 may be of alternative configurations, for example, include a rigid bottom portion to reinforce the bottom 416 of the pouch 406 and/or two or more side edge portions to further reinforce the sides of the pouch.

Referring now to FIG. 3A, depicted is a schematic view of an exemplary bottle pouch 406 with a rigid internal support 300 being positioned into the fitment 400 of the pouch 406 in view of an aspect of an exemplary embodiment. The rigid internal support 300 is slid into the bottle pouch 406 through the fitment 400 while it is in an unexpanded position. The engagement feature 304 of the rigid internal support 300 interlocks into the fitment 400 of the pouch 406 to keep it from dropping into it. The rigid internal support 300 includes also the handle portion 308 and the front or side edge portion 310. The handle portion 308 slides into the portion of the pouch 306 adjacent to the handle region 412 to provide rigidity for ease of handling. The side edge portion 310 as it is slid into the pouch 306 expands up against the front edge 414 to provide rigidity to the front edge 414 section of the pouch 306.

Referring now to FIG. 3B, depicted is a schematic view of an exemplary internal support 300 for the handle region 412 and front edge 414 of a bottle pouch 406 in the expanded position in view of an aspect of an exemplary embodiment. The rigid internal support 300 of FIG. 3B is similar to the rigid internal support of FIG. 3 and FIG. 3A, except that it also includes an additional rigid support member 309 for the inside of the handle 412. Hence, there is a rigid support member on both sides 308, 309 of the handle 412. The rigid internal support 300 includes also the engagement member 304, the handle portion 308, 309, and the side edge portion 310. The handle portion of 308 may also be optionally extended via an additional extended leg portion 309 to the bottom 416 or near the bottom 416 of the pouch.

In another form of the embodiments of FIGS. 3, 3A and 3B, the pouch may not have a handle, but the rigid internal supports may still be used to reinforce the edges of the pouch. In yet another form of the embodiments of FIGS. 3, 3A and B, the pouch may have a rigid internal support that includes an engagement feature that locks into the fitment of the pouch and a handle portion.

Figure 4:
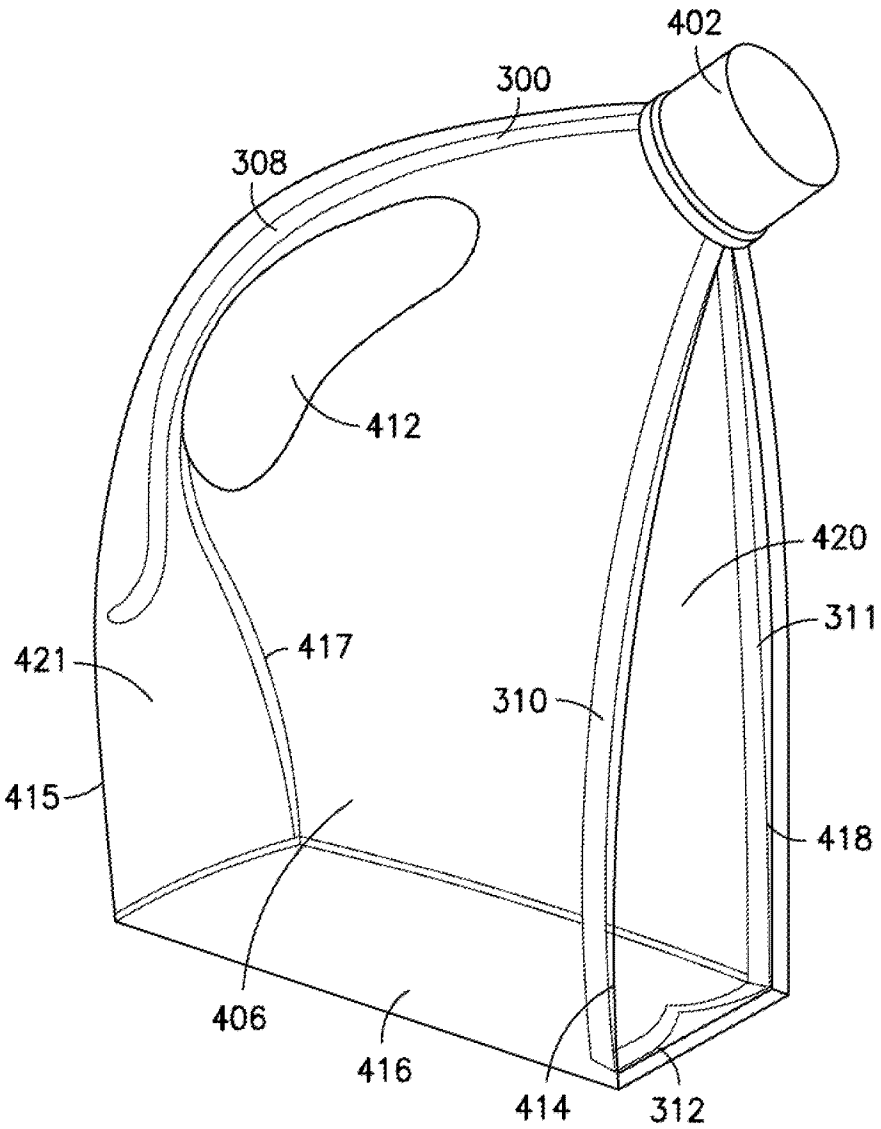
FIG. 4 is a schematic view of an exemplary pouch with an internal support for the handle and a side in view of an aspect of an exemplary embodiment.

Referring now to FIG. 4, a schematic view of another exemplary bottle pouch 406 with a rigid internal support 300 for the handle 412 and the front wall 420 and rear wall 421 is depicted. The bottle pouch 406 includes a fitment 400 for dispensing the contents (not shown) of the bottle pouch 406. The fitment 400 may also include a cap 402 for sealing the contents of the bottle pouch 406. The bottle pouch 406 also includes edge sections 414, 418 for the front vertical wall and edge sections 415, 417 for the rear vertical wall 421 as well as a bottom 416 section. The bottle pouch 406 may be of any suitable shape for dispensing either solid or liquid contents with the handle 412 functioning to ease the pouring of the bottle pouch 406 contents. Because the bottle pouch 406 is made of a flexible type material, it is flimsy and hence difficult to dispense the liquid or solid contents, and in particular as the remaining contents of the bottle pouch 406 decrease in volume. Hence a rigid internal support 300 is inserted into the bottle pouch 406 to increase its rigidity and improve ease of handling in certain portions of the bottle pouch 406. The exemplary rigid internal support 300 in FIG. 4 includes an engagement feature 304 in its expanded position that locks into the fitment 400 of the bottle pouch 406, a handle portion 308 and front vertical wall portion that includes two vertical legs 310, 311 and an optional horizontal leg 312 at or near the bottom front edge 419 of the pouch. The front vertical wall portion includes two vertical legs 310, 311 and an optional horizontal leg 312 that reinforce the front wall 420 of the pouch 406. The exemplary rigid internal support 300 is internal to the bottle pouch 406 and increases the rigidity in the handle 412 and the front wall 420 to ease handling of the pouch 406 and the pouring of its contents.

Figure 4B:
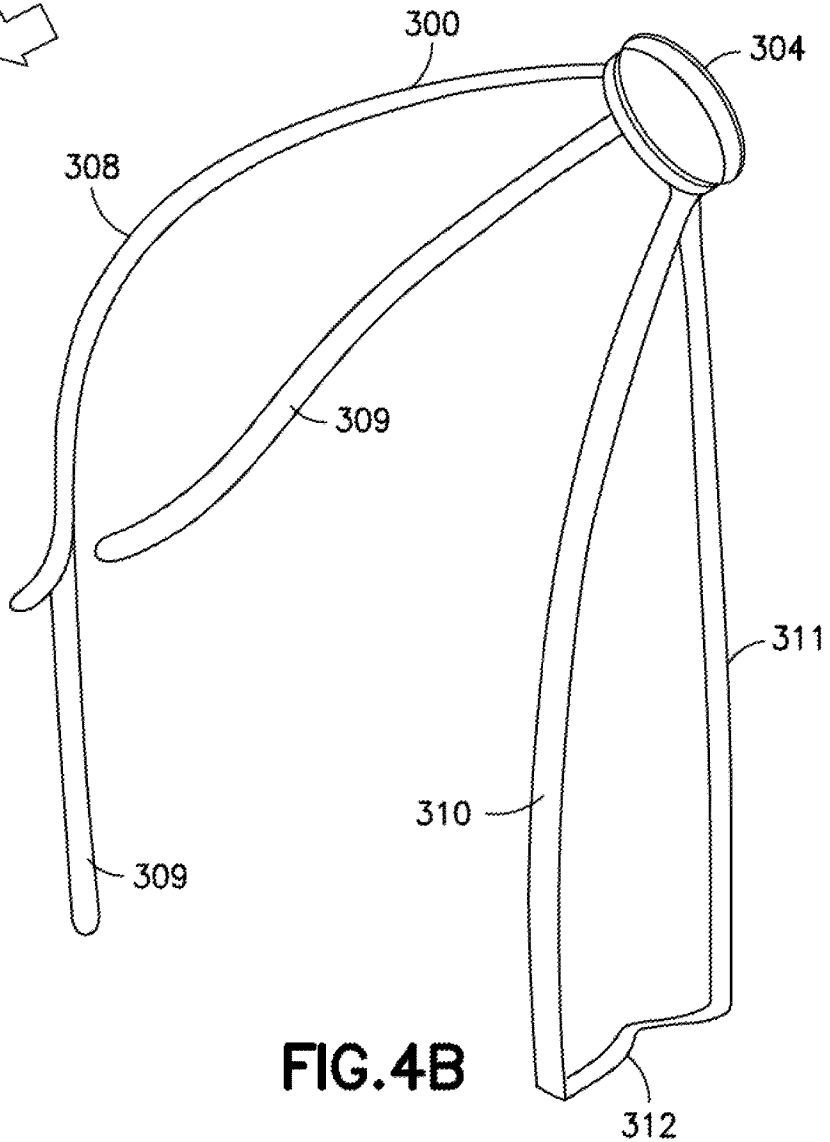
FIG. 4B is a schematic view of an exemplary internal support for the handle region and a side of a pouch in the expanded position in view of an aspect of an exemplary embodiment.
Figure 4A:
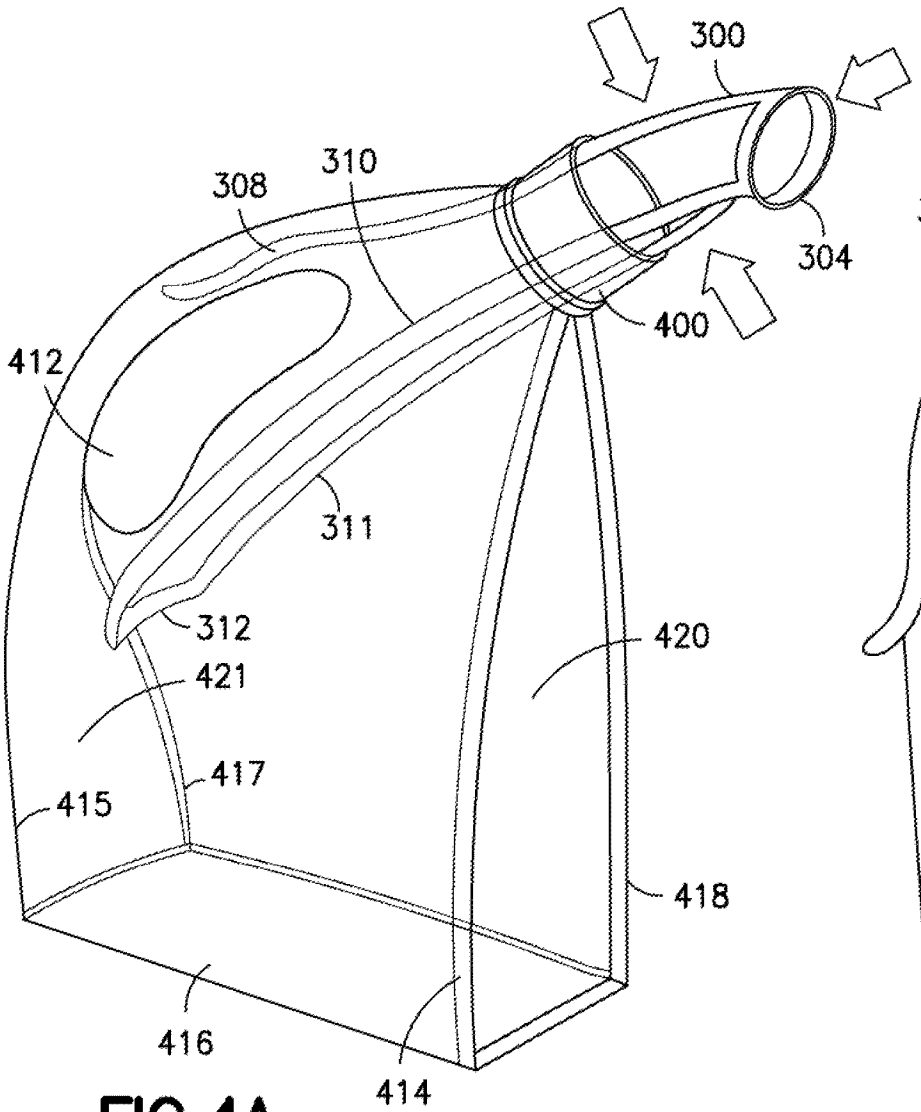
FIG. 4A is a schematic view of an exemplary pouch with an internal support being positioned into the fitment of the pouch in view of an aspect of an exemplary embodiment.

Referring now to FIG. 4A, depicted is a schematic view of an exemplary bottle pouch 406 with a rigid internal support 300 being positioned into the fitment 400 of the pouch 406 in view of an aspect of an exemplary embodiment. The rigid internal support 300 is slid into the bottle pouch 406 through the fitment 400 while it is in an unexpanded position. The engagement feature 304 of the rigid internal support 300 interlocks into the fitment 400 of the pouch 406 to keep it from dropping into it. The rigid internal support 300 includes also the handle portion 308 and front vertical wall portion that includes two vertical legs 310, 311 and an optional horizontal leg 312 at or near the bottom front edge 312 of the pouch 406. The handle portion 308 slides into the portion of the pouch 306 adjacent to the handle 412 to provide rigidity for ease of handling. The front vertical wall portion 310, 311, 312 as it is slid into the pouch 306 expands up against the front vertical wall 414 to provide rigidity to the front of the pouch 306.

Referring now to FIG. 4B, depicted is a schematic view of an exemplary internal support 300 for the handle region 412 and front vertical wall edge portion 310, 311, 312 of a bottle pouch 406 in the expanded position in view of an aspect of an exemplary embodiment. The rigid internal support 300 of FIG. 4B is similar to the rigid internal support of FIG. 4 and FIG. 4A, except that it also includes an additional rigid support member 309 for the inside of the handle 412. Hence, there is a rigid support member on both sides 308, 309 of the handle 412. The rigid internal support 300 includes also the engagement member 304, the handle portion 308 and the front vertical wall portion 310, 311, 312. The handle portion may also be optionally extended via an additional extended leg portion 309 to the or near the bottom 416 of the pouch 406. In another form of the embodiments of FIGS. 4, 4A and 4B, the pouch may not have a handle, but the rigid internal supports may still be used to reinforce the vertical front wall of the pouch. In yet another form of the embodiments of FIGS. 4, 4A and 4B, the pouch may have a rigid internal support that includes an engagement feature that locks into the fitment of the pouch and a handle portion.

Figure 5B:
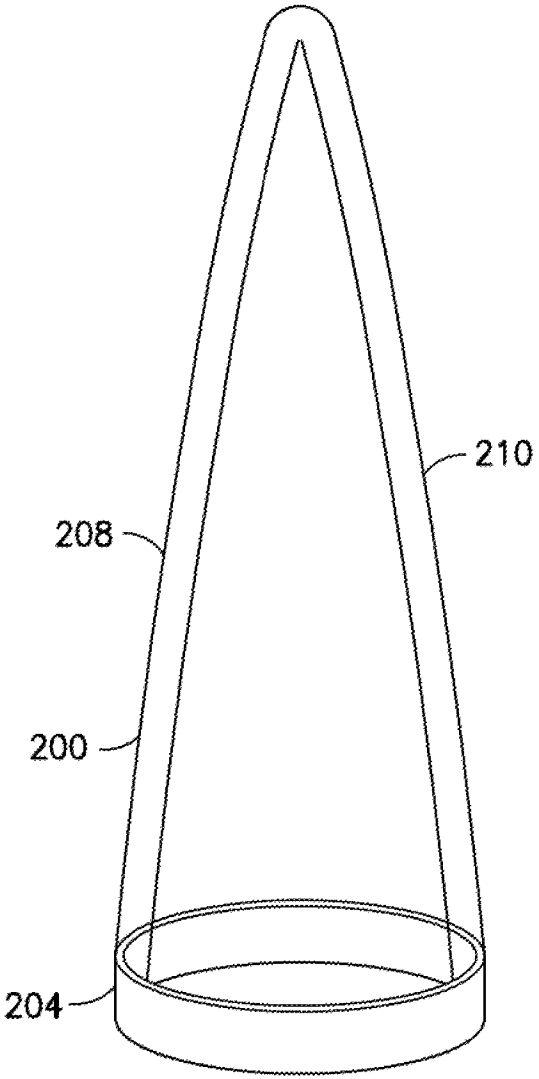
FIG. 5B is a schematic view of an exemplary internal support for the sides and bottom of a tube pouch in view of an aspect of an exemplary embodiment.
Figure 5:
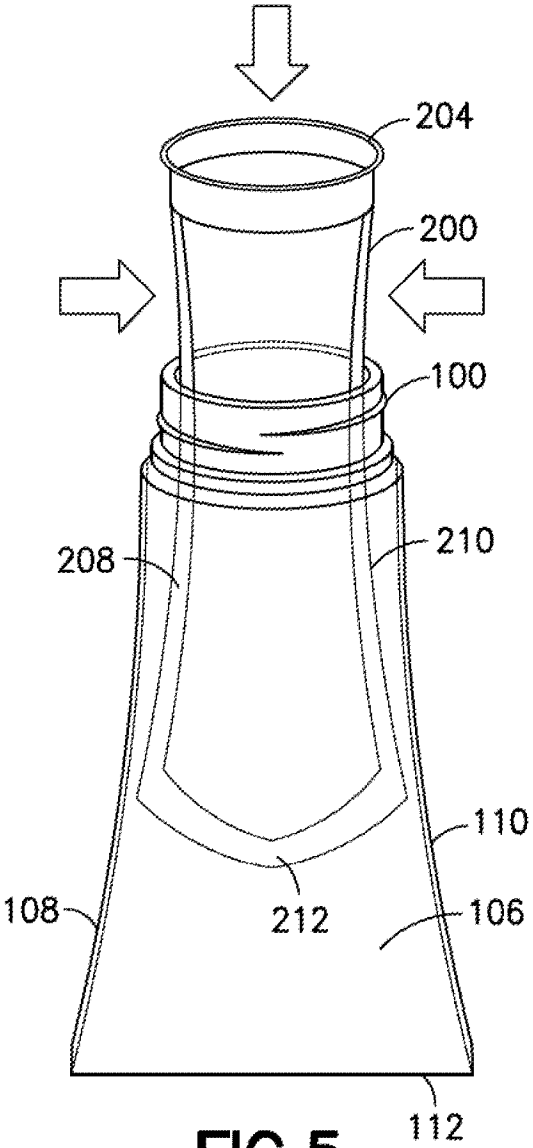
FIG. 5 is a schematic view of an exemplary tube pouch with an internal support being positioned into the fitment of the pouch in view of an aspect of an exemplary embodiment.

Referring now to FIG. 5, depicted is a schematic view of an exemplary tube pouch 106 with a rigid internal support 200 being positioned into the fitment 100 of the pouch 106 for the side edges 108, 110 and optionally bottom edge 112 in view of an aspect of an exemplary embodiment. The tube pouch 106 includes side edges 108, 110 and bottom edge 112 as well as a fitment 100 and a cap (not shown). The tube pouch may contain a liquid (high or low viscosity) or a solid. Without the use of a rigid internal support member 200, the tube pouch is generally flimsy, and in particular, as the contents are consumed. The rigid internal support 200 slides into the fitment 100 opening and the engaging member 204 engages and locks into the fitment 100, for example, as depicted in FIG. 1B. The rigid internal support 200 includes an engaging member 204, side legs 208, 210 and an optional bottom leg 212. The side legs 208, 210 expand against the side edges 108, 110 of the pouch 106 and help reinforce and provide lateral support to this area of the pouch 106. The optional bottom leg 212 expands against the bottom edge 112 and helps reinforce and provide bottom support to this area of the pouch 106.

Figure 5A:
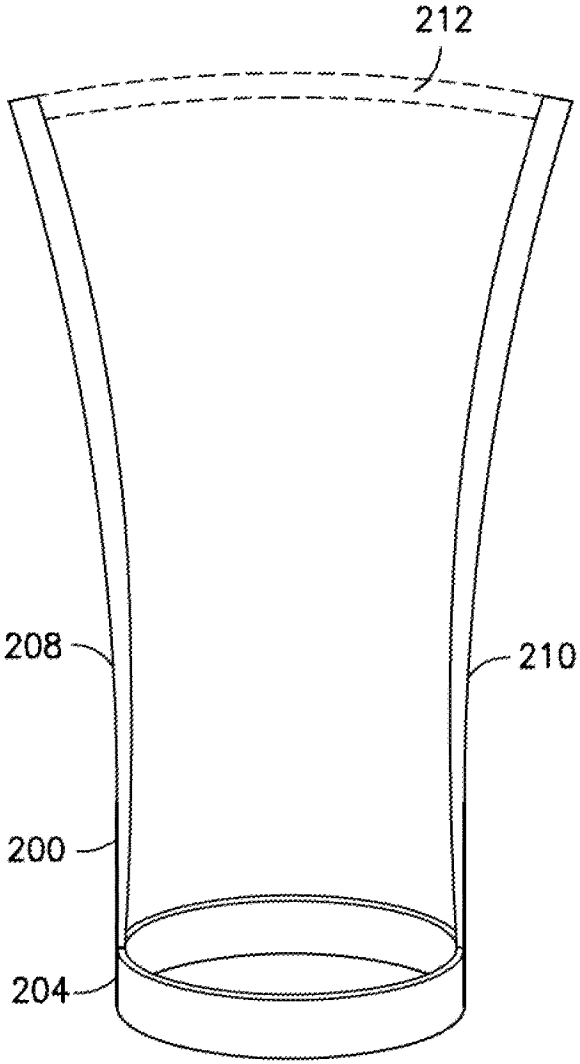
FIG. 5A is a schematic view of an exemplary tube pouch with an internal support for the side edges and optionally bottom of the pouch in view of an aspect of an exemplary embodiment.

Referring now to FIG. 5A, depicted is a schematic view of an exemplary internal support 200 for the sides and optionally bottom of a tube pouch in view of an aspect of an exemplary embodiment. The rigid internal support 200 includes an engaging member 204 for matting to the fitment, side legs 208, 210 and an optional bottom leg 212. After the rigid internal support 200 is slid into the fitment of the tube pouch and held in place by the engaging member 204, the side legs 208, 210 and optional bottom leg 212 expand against the side edges and bottom of the pouch.

Referring now to FIG. 5B, depicted is a schematic view of an exemplary internal support 200 for the sides and optionally bottom of a tube pouch in view of an aspect of an exemplary embodiment. The rigid internal support 200 includes an engaging member 204 for matting to the fitment, and side legs 208, 210 that are connected to each other in the shape of a "V". After the rigid internal support 200 is slid into the fitment of the tube pouch and held in place by the engaging member 204, the side legs 208, 210 expand against the side edges and bottom or near bottom of the pouch. Hence, in this form, there is no lateral support as shown in FIGS. 5 and 5A, but just the two side legs 208, 210, which are connected at the top of the "V".

Figure 6A:
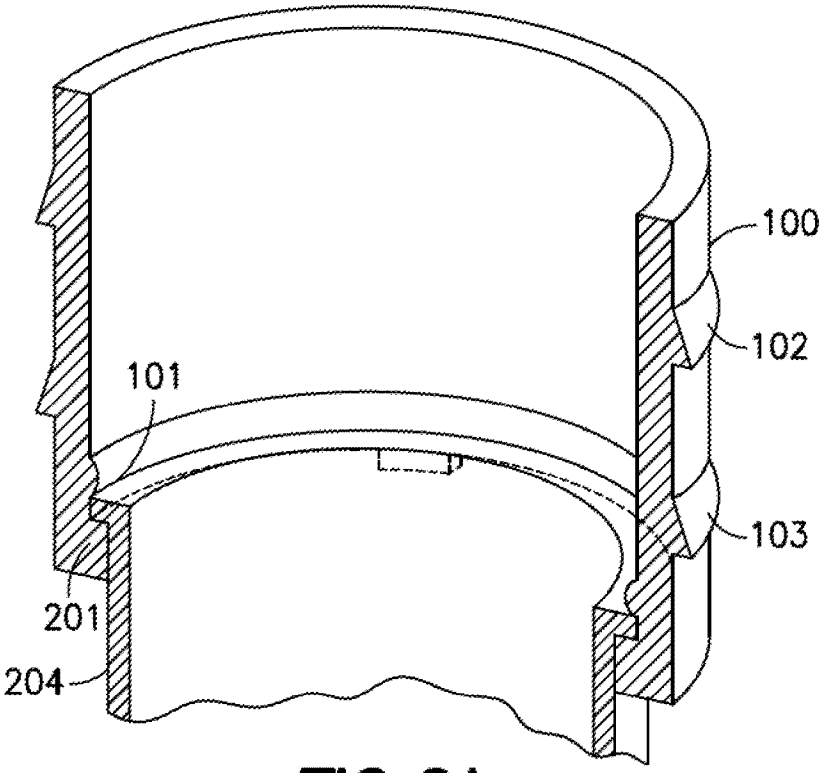
FIG. 6A is a cutaway schematic view of a fitment and internal support positioned into the lip of the fitment in view of an aspect of the exemplary embodiment.
Figure 6:
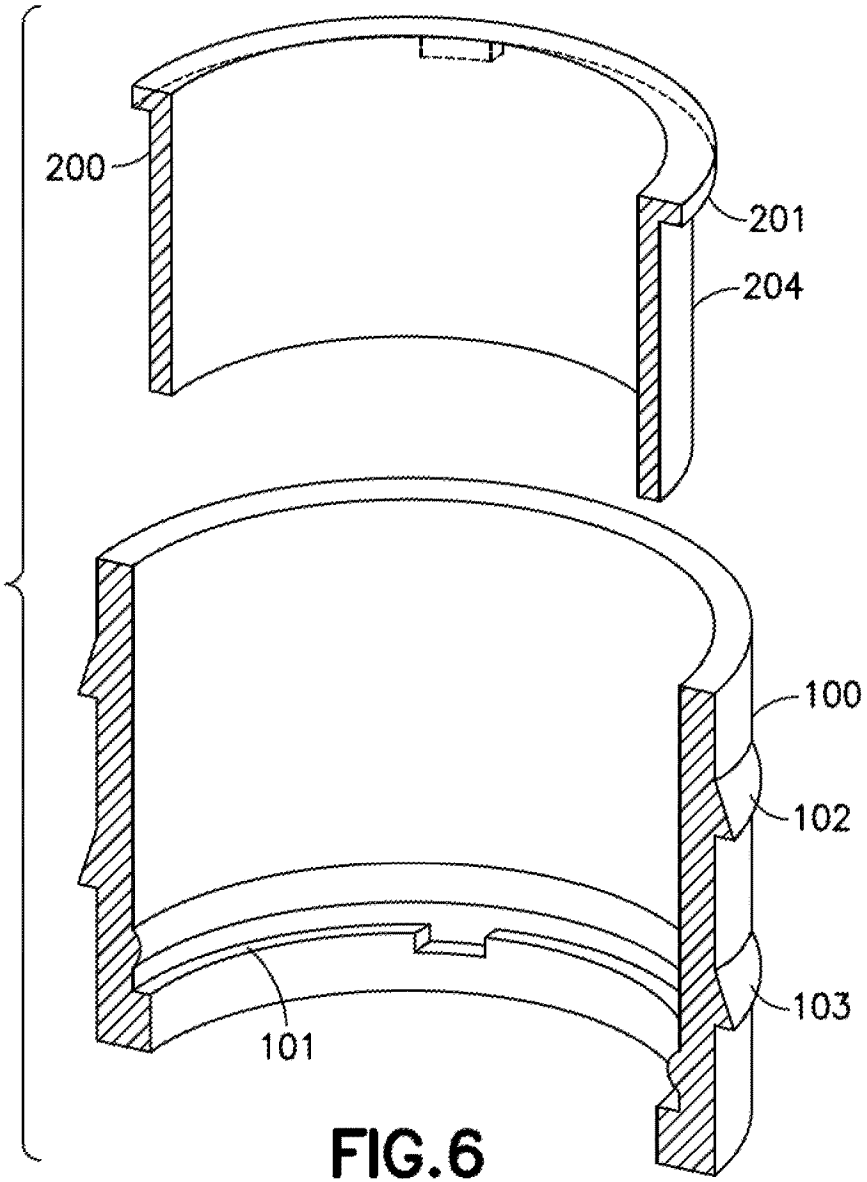
FIG. 6 is a cutaway schematic view of a fitment and internal support being slid into the lip of the fitment in view of an aspect of the exemplary embodiment.

Referring now to FIG. 6, depicted is a cutaway schematic view of a fitment 100 and internal support 200 engaging member 204 being slid into the lip or groove 101 of the fitment 100 in view of an aspect of the exemplary embodiment. The engaging member 204 has an outside diameter that is smaller than the inside diameter of the fitment 100. The engaging member 204 includes a lip 201 that engages the lip or groove 101 on the inside of the fitment 100. The lip 201 of the engaging member snaps into the ridge of the lip 101 of the fitment 100 to keep it in place.

Referring now to FIG. 6A, depicted is a cutaway schematic view of a fitment 100 and internal support 200 engaging member 204 locked into the lip or groove 101 of the fitment 100 in view of an aspect of the exemplary embodiment. The engaging member 204 of the internal support 200 snaps into the fitment 100 by the lip 201 of the engaging member 204 locking into the lip or groove 101 on the inside diameter of the fitment 100. This is one exemplary non-limiting way that the rigid internal support 200 may be connected or locked into the fitment 100 of the pouch, but other similar methods may be contemplated.

Figure 7A:
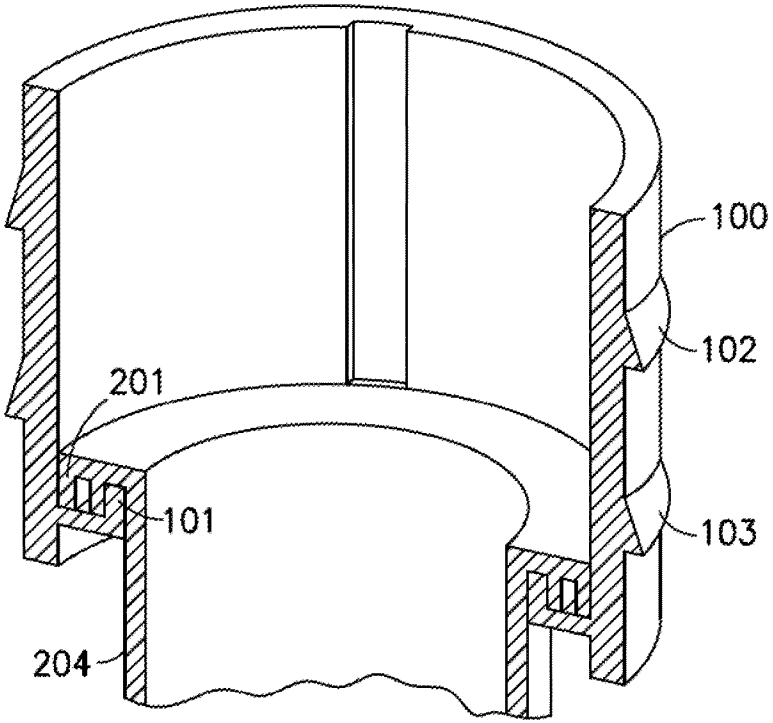
FIG. 7A is a cutaway schematic view of a fitment and internal support positioned into the rail of the fitment in view of another aspect of the exemplary embodiment.
Figure 7:
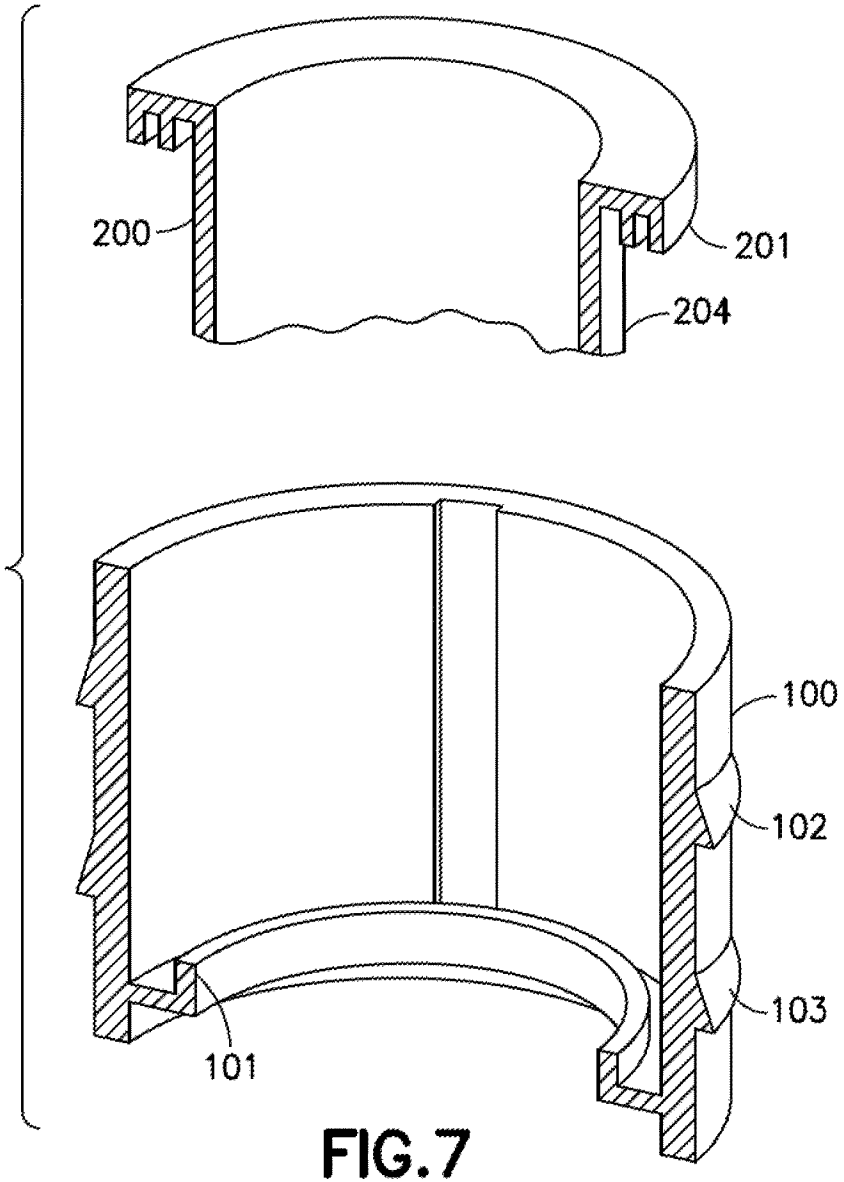
FIG. 7 is a cutaway schematic view of a fitment and internal support being slid into the rail of the fitment in view of another aspect of the exemplary embodiment.

Referring now to FIG. 7, depicted is a cutaway schematic view of a fitment 100 and internal support 200 engaging member 204 being slid into the ridge or channel 101 of the fitment 100 in view of an aspect of the exemplary embodiment. The engaging member 204 has an outside diameter that is smaller than the inside diameter of the fitment 100. The engaging member 204 includes at least one tooth 201 that engages the ridge or channel 101 on the inside of the fitment 100. The at least one tooth 201 of the engaging member 204 locks into the ridge or channel 101 of the lip 101 of the fitment 100 to keep it in place.

Referring now to FIG. 7A, depicted is a cutaway schematic view of a fitment 100 and internal support 200 engaging member 204 locked into the ridge or channel 101 of the fitment 100 in view of an aspect of the exemplary embodiment. The engaging member 204 includes at least one tooth 201 that engages the ridge or channel 101 on the inside diameter of the fitment 100. The at least one tooth 201 of the engaging member 204 locks into the ridge or channel 101 of the lip 101 of the fitment 100 to keep it in place. This is one exemplary non-limiting way that the rigid internal support 200 may be connected or locked into the fitment 100 of the pouch, but other similar methods may be contemplated.

Figure 8:
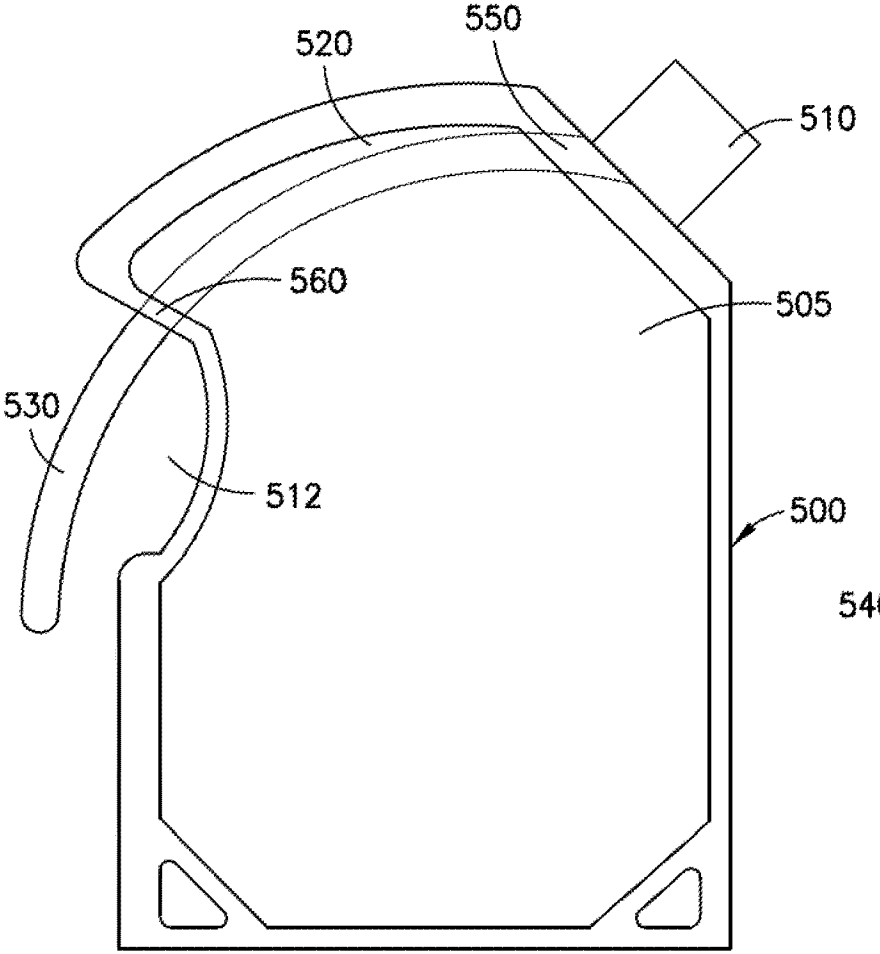
FIG. 8 is a schematic view of an exemplary bottle pouch with an internal and external support for the handle wherein the internal portion of the handle passes within the main pouch body in view of an aspect of an exemplary embodiment.

Referring now to FIG. 8, depicted is a schematic view of an exemplary bottle pouch with an internal and external support for the handle wherein the internal portion of the handle passes within the pouch body in view of an aspect of an exemplary embodiment. The bottle pouch with an internal support 500 of FIG. 8 includes a flexible pouch body 505 for storing the pouch contents (not shown) with a fitment 510 coupled to an inner support handle piece 520 extending into the inside of the flexible pouch body 505 (wherein contents of the pouch are stored) through the interior or inside diameter of the fitment 510. In one form, the fitment 510 and inner support handle piece 520 may be one contiguous piece with the inner support handle piece 520 injection molded into the fitment 510 and extending through the interior 550 of the fitment 510 into the flexible pouch body 505. In this form, the combined fitment 510 and inner support handle piece 520 are unitary and include a rigid handle portion 530 (also referred to as the outer support handle piece) for reinforcing the handle region 512 of the bottle pouch 500. The handle region 512 of the bottle pouch is the region of the flexible pouch 550 wherein a cut-out or indentation exists in the pouch for the user to insert his or her hand in order to grasp the rigid handle portion 530, which is adjacent to or within the handle region 512. In another form, the combined fitment 510 and inner support handle piece 520 may be two separate pieces that are coupled together. In this form, the fitment 510 includes a fitment inner engagement feature (as shown in FIG. 1) and the inner support handle piece 520 includes an inner support handle piece engagement feature (as shown in FIG. 1B), wherein the fitment inner engagement feature and inner support handle piece engagement feature are interlocked to keep the inner support handle piece 520 from falling into or out of the flexible pouch body 505. In this form, the combined fitment 510 and inner support handle piece 520 also includes a rigid handle portion 530 (also referred to as an outer support handle piece) extending from the inner support handle piece that forms the rigid handle 530 of the bottle pouch. The rigid handle portion 530 is preferably a single outer support handle piece that extends linearly from and is unitary with the inner support handle piece, but may optionally include a second outer support handle piece (not shown) extending from the inner support handle piece 520. When the rigid handle portion includes a second outer support handle piece, the first and second outer support handle pieces propagate from the end of the inner support handle piece in a "Y" shape configuration to allow the user to grasp two closely positioned rigid handle portions, which may be advantageous for large and heavy bottle pouches.

Again referring to FIG. 8, the inner support handle piece 520 passes from the inside (wherein contents of the pouch are stored) of the bottle pouch 500 to the outside of the bottle pouch 500 to become an outer support handle piece 530. The outer support handle piece 530 is located adjacent to or proximate to the handle region 512 of the bottle pouch 500. The outer support handle piece 530 functions as a handle for the bottle pouch 500 and reinforces the handle region 512 of the bottle pouch 500. The rigid handle portion 530 is slid into the portion of the flexible pouch body 505 adjacent to the handle region 512 to provide rigidity for ease of handling. The inner support handle piece 520 passes through the interior or inside diameter 550 of the fitment 510 of the bottle pouch 500 into the flexible pouch body 505. The inner support handle piece 520 then passes from the flexible pouch body 505 through the outer seal region 560 of the bottle pouch 500 proximate the handle region 512 to become the outer support handle piece 530, which is located outside the flexible pouch body 505. The outer support handle piece 530 reinforces the handle region 512 of the bottle pouch 500 and allows for ease of handling the bottle pouch 500 while dispensing contents (not shown) inside the flexible pouch body 505 through the fitment 510 to the outside of the bottle pouch 500.

Figure 9:
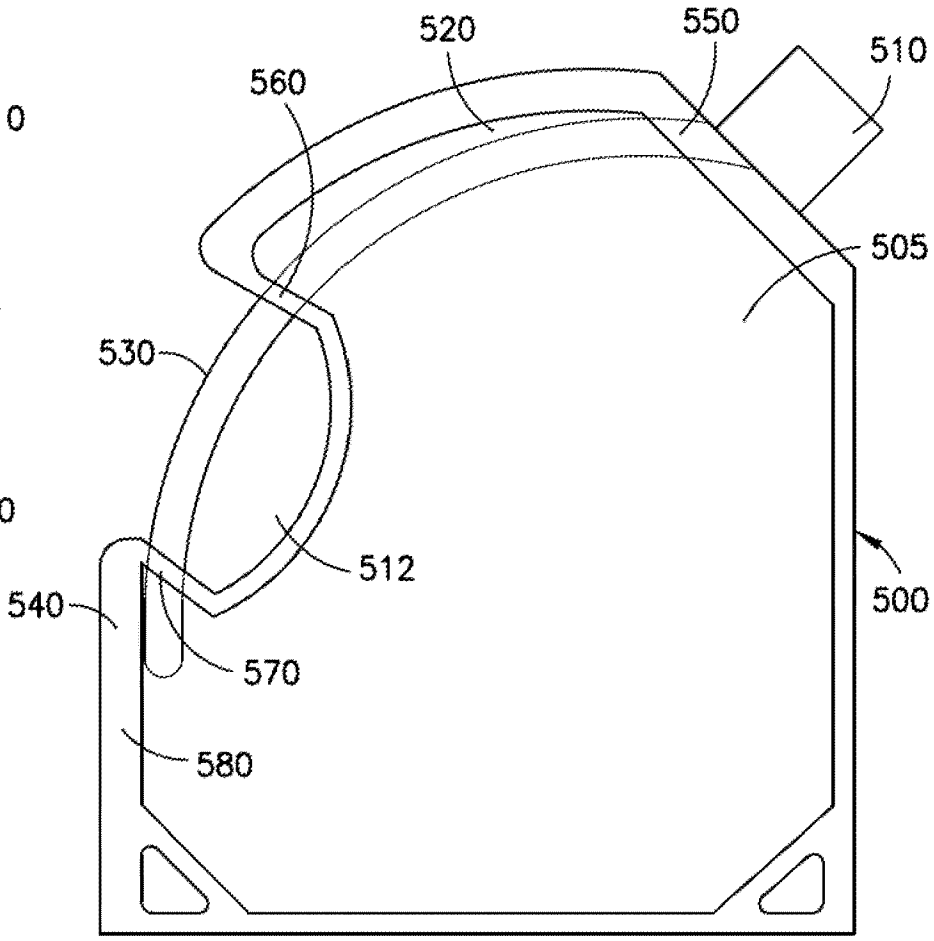
FIG. 9 is another schematic view of an exemplary bottle pouch with an internal and external support for the handle wherein the internal portion of the handle passes within the main pouch body in view of another aspect of an exemplary embodiment.

Referring now to FIG. 9, depicted is a schematic view of another exemplary pouch with an internal and external support for the handle wherein the internal portion of the handle passes within the pouch body in view of an aspect of an exemplary embodiment. The bottle pouch with an internal support 500 of FIG. 9 includes a flexible pouch body 505 for storing the pouch contents (not shown) with a fitment 510 coupled to an inner support handle piece 520 extending into the inside of the flexible pouch body 505 (wherein contents of the pouch are stored) through the interior or inside diameter of the fitment 510. In one form, the fitment 510 and inner support handle piece 520 may be one contiguous piece with the inner support handle piece 520 injection molded into the fitment 510 and extending through the interior or inside diameter 550 of the fitment 510 into the flexible pouch body 505. In this form, the combined fitment 510 and inner support handle piece 520 are unitary and include a rigid handle portion 530 (also referred to as the outer support handle piece) for reinforcing the handle region 512 of the bottle pouch 500. The handle region 512 of the bottle pouch is the region of the flexible pouch 550 wherein a cut-out or indentation exists in the pouch for the user to insert his or her hand in order to grasp the rigid handle portion 530, which is adjacent to or within the handle region 512. In another form, the combined fitment 510 and inner support handle piece 520 may be two separate pieces that are coupled together. In this form, the fitment 510 includes a fitment inner engagement feature (as shown in FIG. 1) and the inner support handle piece 520 includes an inner support handle piece engagement feature (as shown in FIG. 1B), wherein the fitment inner engagement feature and inner support handle piece engagement features are interlocked to keep the inner support handle piece 520 from falling into or out of the flexible pouch body 505. In this form, the combined fitment 510 and inner support handle piece 520 also includes a rigid handle portion 530 (also referred to as an outer support handle piece) extending from the inner support handle piece 520 that forms the rigid handle of the bottle pouch 500. The rigid handle portion 530 is preferably a single outer support handle piece that extends linearly from and is unitary with the inner support handle piece, but may optionally include a second outer support handle piece (not shown) extending from the inner support handle piece 520. When the rigid handle portion includes a second outer support handle piece, the first and second outer support handle pieces propagate from the end of the inner support handle piece in a "Y" shape configuration to allow the user to grasp two closely positioned rigid handle portions, which may be advantageous for large and heavy bottle pouches.

Again referring to FIG. 9, the inner support handle piece 520 passes from the inside (wherein contents of the pouch are stored) of the bottle pouch 500 to the outside of the bottle pouch 500 to become an outer support handle piece 530. The outer support handle piece 530 is located adjacent to or proximate to the handle region 512 of the bottle pouch 500. The outer support handle piece 530 then passes back into the inside of the pouch 500 and optionally back into the flexible pouch body 505 (wherein the contents of the pouch are stored) to become a second inner support handle piece 540. In another form, the second inner support handle piece 540 may remain in the seal region 580 of the bottle pouch 500 as opposed to passing back into the flexible pouch body 505. The outer support handle piece 530 functions as a handle for the bottle pouch 500 and reinforces the handle region 512 of the bottle pouch 500. The rigid handle portion 530 is slid into the portion of the flexible pouch body 505 adjacent to the handle region 512 to provide rigidity for ease of handling. The inner support handle piece 520 passes through the interior 550 of the fitment 510 of the bottle pouch 500 and then passes into the flexible pouch body 505. The inner support handle piece 520 then passes from the flexible pouch body 505 through the outer seal region 560 of the bottle pouch 500 proximate the upper or top part of the handle region 512 to become the outer support handle piece 530, which is located outside the flexible pouch body 505. The outer support handle piece 530 then passes from the outside of the pouch 500 back into the flexible pouch body 505 through the outer seal region 570 of the bottle pouch 500 proximate the lower or bottom part of the handle region 512 to become the second inner support handle piece 540, which is located inside the flexible pouch body 505 (wherein the contents are located). The outer support handle piece 530 reinforces the handle region 512 of the bottle pouch 500 and allows for ease of handling the bottle pouch 500 while dispensing contents (not shown) inside the flexible pouch body 505 through the fitment 510 to the outside of the bottle pouch 500.

Figure 10:
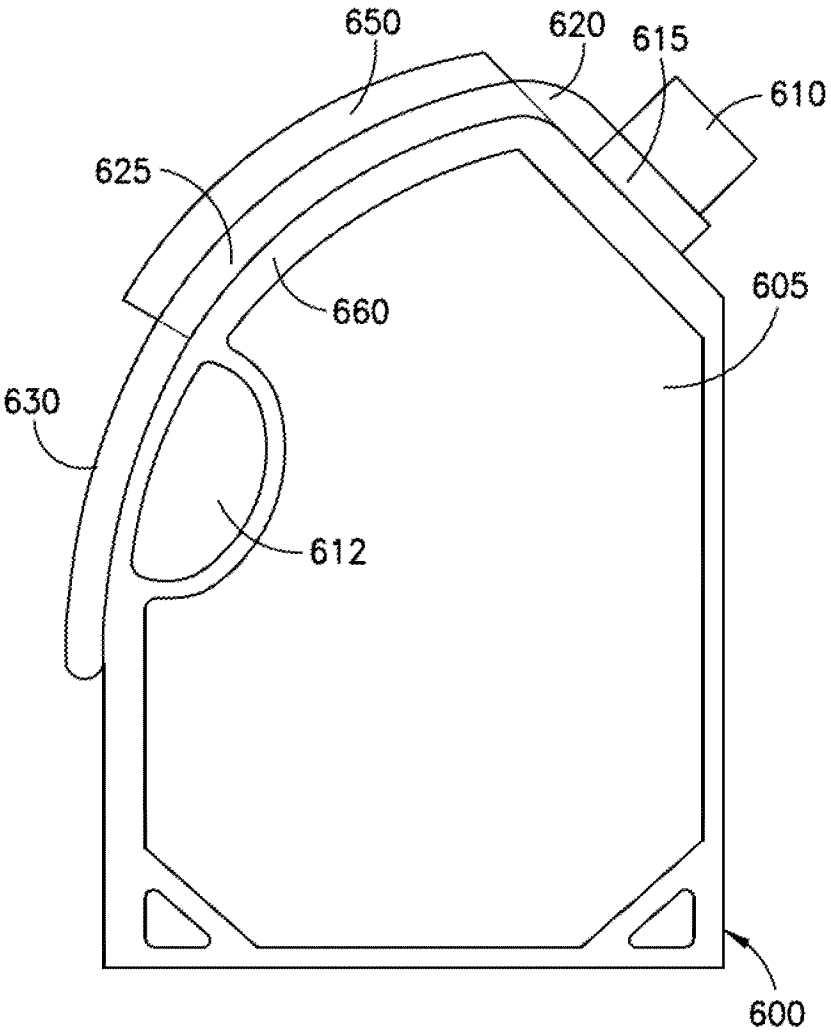
FIG. 10 is a schematic view of an exemplary bottle pouch with an internal and external support for the handle wherein the internal portion of the handle does not pass within the main pouch body in view of another aspect of an exemplary embodiment.

Referring now to FIG. 10, depicted is a schematic view of an exemplary bottle pouch with an internal and external support for the handle wherein the internal portion of the handle does not pass within the contents of the flexible pouch body in view of another aspect of an exemplary embodiment. The bottle pouch 600 with an internal and external support for the handle of FIG. 10 includes a flexible pouch body 605 for storing the pouch contents (not shown) with a fitment 610 coupled to an inner support handle piece 620 extending into an outer sleeve or loop 625 (volume between seal areas 650 and 660) attached to the outer periphery of the flexible pouch body 605 and external to where the contents of the pouch 600 are stored. The outer sleeve or loop 625 is integral to the outer periphery of the flexible pouch or flexible pouch body. It is generally fabricated from the same material as the flexible pouch and hence is also generally flexible with an inner channel through which a semi-rigid or rigid cylindrical shaped rod or body may pass as depicted in FIGS. 10-13. In one form, the fitment 610 and inner support handle piece 620 may be one contiguous piece with the inner support handle piece 620 injection molded into the fitment 610 at an outer surface, outer diameter or outer shoulder 615 of the fitment 610 and extending into the outer sleeve or loop 625 attached to the flexible pouch body 605. In this form, the combined fitment 610 and inner support handle piece 620 are unitary and also include a rigid handle portion 630 (also referred to as the outer support handle piece) for reinforcing the handle region 612 of the bottle pouch 600. The handle region 612 of the bottle pouch is the region of the pouch 600 wherein a cut-out or indentation exists in the pouch for the user to insert his or her hand in order to grasp the rigid handle portion 630, which is adjacent to or within the handle region 612. In another form, the combined fitment 610 and inner support handle piece 620 may be two separate pieces that are coupled together via a slip ring type of mechanism. See FIG. 1A. In this form, the inner support handle piece 620 includes a slip ring 615 at its end that slides over the fitment 610 and mates to a shoulder or collar (not shown) of the fitment 610 in a press fit type of arrangement at 615. This interlocks the inner support handle piece 620 to the fitment 610 to form the combined fitment and internal support handle piece and also allows for the inner support handle piece 620 to be slid into the outer sleeve or loop 625 of the bottle pouch 600. The outer sleeve or loop 625 secures the inner support handle piece 620 to the bottle pouch 600, which serves to reinforce and provide rigidity to top area of the bottle pouch 600. The combined fitment 610 and inner support handle piece 620 also includes a rigid handle portion 630 (also referred to as an outer support handle piece) extending from the inner support handle piece 620 that forms the rigid handle of the bottle pouch 600. The rigid handle portion 630 is preferably a single outer support handle piece that extends linearly from and is unitary with the inner support handle piece, but may optionally include a second outer support handle piece (not shown) extending from the inner support handle piece 620. When the rigid handle portion includes a second outer support handle piece, the first and second outer support handle pieces propagate from the end of the inner support handle piece in a "Y" shape configuration to allow the user to grasp two closely positioned rigid handle portions, which may be advantageous for large and heavy bottle pouches.

Referring again to FIG. 10, there may be at least one, or two, or three, or four outer sleeves or loops coupled to the outer periphery of the flexible pouch body that the inner support handle piece 620 and/or the rigid handle portion 630 (see also FIGS. 11, 12 and 13) may be slid into. For FIGS. 10-13, the at least one outer sleeve or loop may range from 5 to 250 mm, or 10 to 200 mm, or 20 to 150 mm, or 50 to 100 mm in length. For FIGS. 10-13, the at least one outer sleeve or loop may range from 1 to 50 mm, or 5 to 25 mm, or 8 to 20 mm, or 10 to 15 mm in inside diameter. The inner or inside diameter of the at least one outer sleeve or loop is also generally constant over the length of the sleeves or loops. The integral outside diameter of the inner support handle piece and outer support handle piece is slightly less (0.5 to 10 mm, or 1 to 7 mm, or 2 to 5 mm) than inside diameter of the at least one outer sleeve or loop such that the inner support handle piece and outer support handle piece may be easily slid through the at least one outer sleeve or loop. Hence, the outer or outside diameter of the integral inner support handle piece and outer support handle piece may range from 0.5 to 48 mm, or 3 to 23 mm, or 6 to 18 mm, or 7 to 12 mm. The outer or outside diameter of the integral inner support handle piece and outer support handle piece is also generally constant over its length.

Again referring to FIG. 10, the inner support handle piece 620 passes from the inside of the outer sleeve or loop 625 of the bottle pouch 600 to the outside of the bottle pouch 600 to become an outer support handle piece 630 (also referred to as a rigid handle portion). The outer support handle piece 630 is located adjacent to or proximate to the handle region 612 of the bottle pouch 600. The outer support handle piece 630 functions as a handle for the bottle pouch 600 and reinforces the handle region 612 of the bottle pouch 600. The inner support handle piece 620 passes from exterior of the fitment at 615 of the bottle pouch 600 into the at least one outer sleeve or loop 625 of the flexible pouch body 605. The inner support handle piece 620 then passes outside the outer sleeve or loop 625 proximate the handle region 612 to become the outer support handle piece 630, which is located outside the flexible pouch body 605. The outer support handle piece 630 reinforces the handle region 612 of the bottle pouch 600 and allows for ease of handling the bottle pouch 600 while dispensing contents (not shown) inside the flexible pouch body 605 through the fitment 610 to the outside of the bottle pouch 600.

Figure 11:
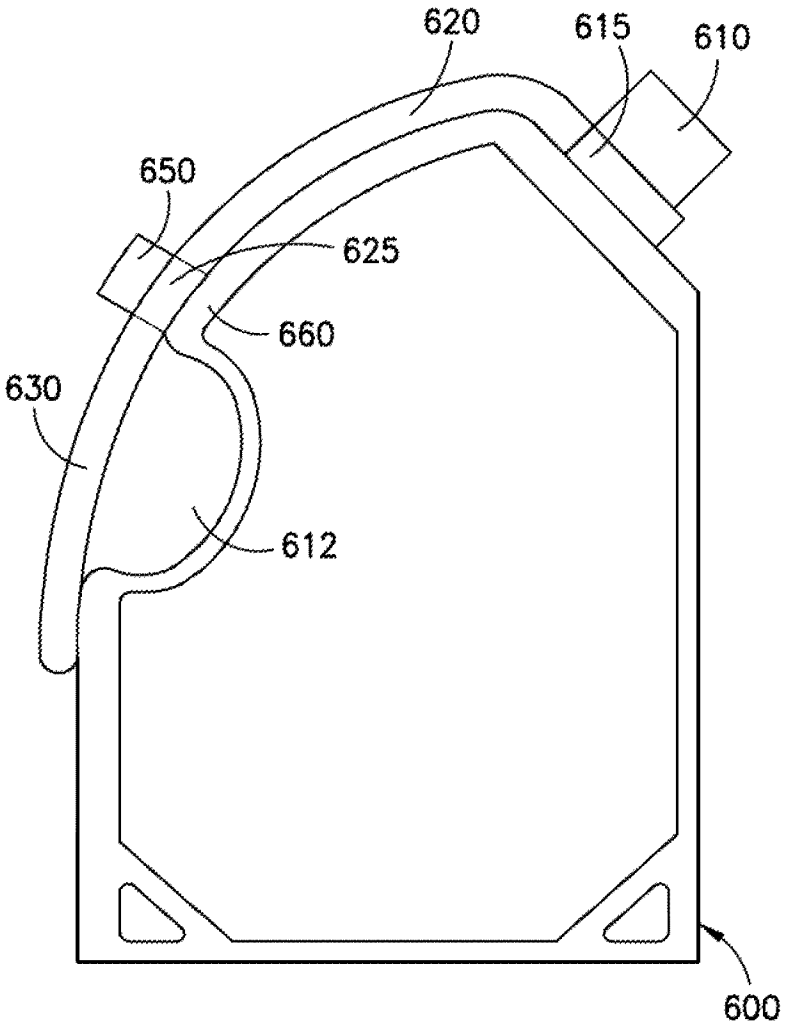
FIG. 11 is another schematic view of an exemplary bottle pouch with an internal and external support for the handle wherein the internal portion of the handle does not pass within the main pouch body in view of another aspect of an exemplary embodiment.

Referring now to FIG. 11, depicted is another schematic view of an exemplary bottle pouch with an internal and external support for the handle wherein the internal portion of the handle does not pass within the flexible pouch body in view of another aspect of an exemplary embodiment. FIG. 11 is analogous to FIG. 10 except that the outer sleeve or loop 625 for securing the inner support handle piece to the periphery of the flexible pouch body 605 is smaller in length and is a single loop as opposed to a single sleeve. The bottle pouch 600 with an internal and external support for the handle of FIG. 11 includes a flexible pouch body 605 for storing the pouch contents (not shown) with a fitment 610 coupled to an inner support handle piece 620 extending around the outer periphery at the top of the flexible pouch body 605. Then the inner support handle piece 620 extends into an outer sleeve or loop 625 (volume between seal areas 650 and 660) attached to the outer periphery of the flexible pouch body 605 and external to where the contents of the pouch 600 are stored. As in FIG. 10, the fitment 610 and inner support handle piece 620 may be one contiguous piece with the inner support handle piece 620 molded into the fitment 610 at an outer surface, collar or shoulder 615 of the fitment 610. In this form, the combined fitment 610 and inner support handle piece 620 are unitary and also includes a rigid handle portion 630 (also referred to as the outer support handle piece) for reinforcing the handle region 612 of the bottle pouch 600. The handle region 612 of the bottle pouch is the region of the flexible pouch 600 wherein a cut-out or indentation exists in the pouch for the user to insert his or her hand in order to grasp the rigid handle portion 630, which is adjacent to or within the handle region 612. In another form, the combined fitment 610 and inner support handle piece 620 may be two separate pieces that are coupled together via a slip ring type of mechanism. See FIG. 1A. In this form, the inner support handle piece 620 includes a slip ring 615 at its end that slides over the fitment 610 and mates to a shoulder or collar (not shown) of the fitment 610 in a press fit type of arrangement at 615. This interlocks the inner support handle piece 620 to the fitment 610 to form the combined fitment and internal support handle piece. The outer sleeve or loop 625 secures the inner support handle piece 620 to the bottle pouch 600, which serves to reinforce and provide rigidity to top area of the bottle pouch 600. The combined fitment 610 and inner support handle piece 620 also includes a rigid handle portion 630 (also referred to as an outer support handle piece) extending from the inner support handle piece 620 that forms the rigid handle of the bottle pouch 600. The rigid handle portion 630 is preferably a single outer support handle piece that extends linearly from and is unitary with the inner support handle piece, but may optionally include a second outer support handle piece (not shown) extending from the inner support handle piece 620. When the rigid handle portion includes a second outer support handle piece, the first and second outer support handle pieces propagate from the end of the inner support handle piece in a "Y" shape configuration to allow the user to grasp two closely positioned rigid handle portions, which may be advantageous for large and heavy bottle pouches.

The bottle pouch of FIG. 11 may also include an additional one, two, or three outer sleeves or loops coupled to the outer periphery of the flexible pouch body 605 above the handle region 612 for further securing the inner support handle piece 620 to the flexible pouch body 605 of the bottle pouch 600. Again referring to FIG. 11, the inner support handle piece 620 passes from the inside of the outer sleeve or loop 625 of the bottle pouch 600 to the outside of the bottle pouch 600 proximate or adjacent to the handle region 612 to become an outer support handle piece or rigid handle portion 630. The rigid handle portion or outer support handle piece 630 functions as a handle for the bottle pouch 600 and reinforces the handle region 612 of the bottle pouch 600 and allows for ease of handling the bottle pouch 600 while dispensing contents (not shown) inside the flexible pouch body 605 through the fitment 610 to the outside of the bottle pouch 600.

Figure 12:
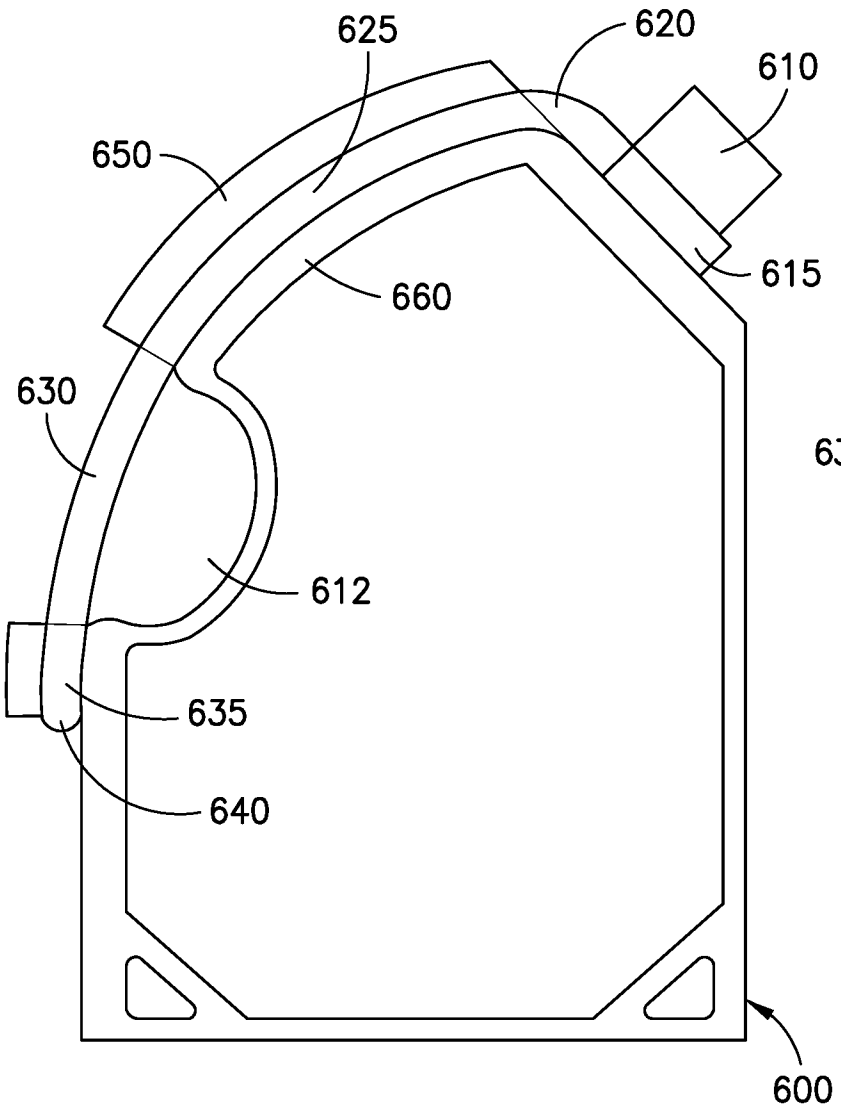
FIG. 12 yet another schematic view of an exemplary bottle pouch with an internal and external support for the handle wherein the internal portion of the handle does not pass within the main pouch body in view of another aspect of an exemplary embodiment.

Referring now to FIG. 12, depicted is yet another schematic view of an exemplary bottle pouch with an internal and external support for the handle wherein the internal portion of the handle does not pass within the flexible pouch body in view of another aspect of an exemplary embodiment. FIG. 12 is analogous to FIG. 10 except that it also includes a second outer sleeve or loop 635 for securing the rigid handle portion or outer support handle piece 630 to the periphery of the flexible pouch body 605 below the handle region 612 of the flexible pouch body 605. The bottle pouch 600 with an internal and external support for the handle of FIG. 12 includes a flexible pouch body 605 for storing the pouch contents (not shown) with a fitment 610 coupled to an inner support handle piece 620 extending around the outer periphery at the top of the flexible pouch body 605. Then the inner support handle piece 620 extends into an outer sleeve or loop 625 (volume between seal areas 650 and 660) attached to the outer periphery of the flexible pouch body 605 and external to where the contents of the pouch 600 are stored. As in FIGS. 10 and 11, the fitment 610 and inner support handle piece 620 may be one contiguous piece with the inner support handle piece 620 molded into the fitment 610 at an outer surface, collar or shoulder 615 of the fitment 610. In this form, the combined fitment 610 and inner support handle piece 620 are unitary and also includes a rigid handle portion 630 (also referred to as the outer support handle piece) for reinforcing the handle region 612 of the bottle pouch 600. The handle region 612 of the bottle pouch is the region of the flexible pouch 600 wherein a cut-out or indentation exists in the pouch for the user to insert his or her hand in order to grasp the rigid handle portion 630, which is adjacent to or within the handle region 612. In another form, the combined fitment 610 and inner support handle piece 620 may be two separate pieces that are coupled together via a slip ring type of mechanism. See FIG. 1A. In this form, the inner support handle piece 620 includes a slip ring 615 at its end that slides over the fitment 610 and mates to a shoulder or collar (not shown) of the fitment 610 in a press fit type of arrangement at 615. This interlocks or secures the inner support handle piece 620 to the fitment 610 to form the combined fitment and internal support handle piece. The outer sleeve or loop 625 secures the inner support handle piece 620 to the bottle pouch 600, which serves to reinforce and provide rigidity to top area of the bottle pouch 600. The combined fitment 610 and inner support handle piece 620 also includes a rigid handle portion 630 (also referred to as an outer support handle piece) extending from the inner support handle piece 620 that forms the rigid handle of the bottle pouch 600. The rigid handle portion 630 is preferably a single outer support handle piece that extends linearly from and is unitary with the inner support handle piece, but may optionally include a second outer support handle piece (not shown) extending from the inner support handle piece 620. When the rigid handle portion includes a second outer support handle piece, the first and second outer support handle pieces propagate from the end of the inner support handle piece in a "Y" shape configuration to allow the user to grasp two closely positioned rigid handle portions, which may be advantageous for large and heavy bottle pouches.

Again referring to FIG. 12, the inner support handle piece 620 passes from the inside of the outer sleeve or loop 625 of the bottle pouch 600 to the outside of the bottle pouch 600 proximate or adjacent to the handle region 612 to become an outer support handle piece or rigid handle portion 630. The rigid handle portion or outer support handle piece 630 functions as a handle for the bottle pouch 600 and reinforces the handle region 612 of the bottle pouch 600 and allows for ease of handling the bottle pouch 600 while dispensing contents (not shown) inside the flexible pouch body 605 through the fitment 610 to the outside of the bottle pouch 600. The bottle pouch 600 of FIG. 12 also includes an additional outer sleeve or loop 635 for securing the end 640 of the rigid handle portion or outer support handle piece 630 to the periphery of the flexible pouch body 605 below the handle region 612 of the bottle pouch 600 in order to provide added stability and rigidity to the bottle pouch while dispensing its contents. The bottle pouch of FIG. 12 with the additional outer sleeve or loop 635 below the handle region 612 may optionally also include an additional one, two, or three additional outer sleeves or loops coupled to the outer periphery of the flexible pouch body below the handle region 612 for further securing the end 640 of the rigid handle portion or outer support handle piece 630 to the periphery of the flexible pouch body 605 of the bottle pouch 600. The need for and the number and length of the additional outer sleeves or loops 635 below the handle region 612 will be dependent on the length of the rigid handle portion 630.

Figure 13:
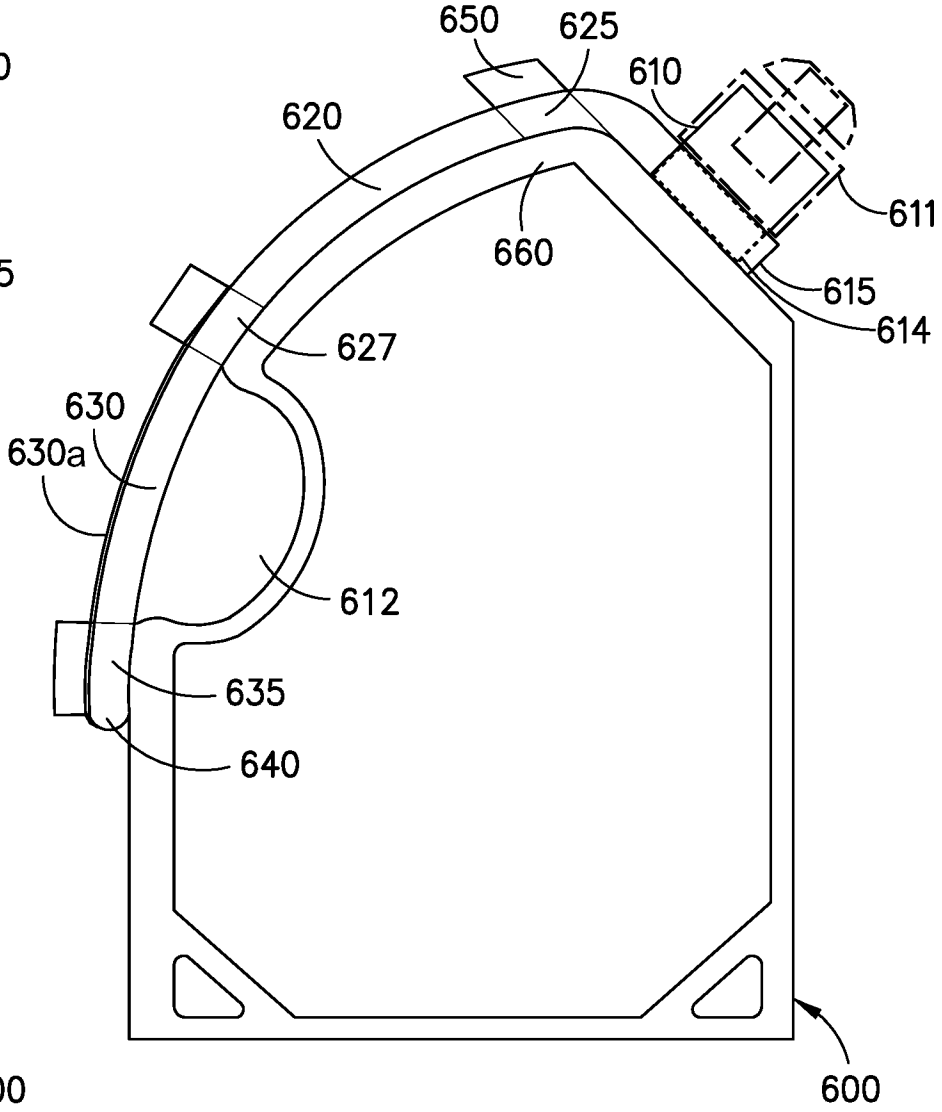
FIG. 13 still yet another schematic view of an exemplary bottle pouch with an internal and external support for the handle wherein the internal portion of the handle does not pass within the main pouch body in view of another aspect of an exemplary embodiment.

Referring now to FIG. 13, depicted is still yet another schematic view of an exemplary bottle pouch with an internal and external support for the handle wherein the internal portion of the handle does not pass within the flexible pouch body in view of another aspect of an exemplary embodiment. FIG. 13 is analogous to FIG. 10 except that the outer sleeve or loop 625 for securing the inner support handle piece 620 to the periphery of the flexible pouch body 605 is smaller in length and includes two loops 625, 627 above the handle region 612 of the bottle pouch 600 as opposed to a single sleeve. The bottle pouch 600 with an internal and external support for the handle of FIG. 13 includes a flexible pouch body 605 for storing the pouch contents (not shown) with a fitment 610 coupled to an inner support handle piece 620 extending around the outer periphery at the top of the flexible pouch body 605. Then the inner support handle piece 620 extends into a first outer sleeve or loop 625 (volume between seal areas 650 and 660) attached to the outer periphery of the flexible pouch body 605 and external to where the contents of the pouch 600 are stored. As in FIGS. 10, 11 and 12, the fitment 610 and inner support handle piece 620 may be one contiguous piece with the inner support handle piece 620 molded into the fitment 610 at an outer surface, collar or shoulder 615 of the fitment 610. In this form, the combined fitment 610 and inner support handle piece 620 are unitary and also includes a rigid handle portion 630 (also referred to as the outer support handle piece) for reinforcing the handle region 612 of the bottle pouch 600. The handle region 612 of the bottle pouch is the region of the flexible pouch 600 wherein a cut-out or indentation exists in the pouch for the user to insert his or her hand in order to grasp the rigid handle portion 630, which is adjacent to or within the handle region 612. In another form, the combined fitment 610 and inner support handle piece 620 may be two separate pieces that are coupled together via a slip ring type of mechanism. See FIG. 1A. In this form, the inner support handle piece 620 includes a slip ring 615 at its end that slides over the fitment 610 and mates to a shoulder or collar 614 of the fitment 610 in a press fit type of arrangement at 615. This interlocks or secures the inner support handle piece 620 to the fitment 610 to form the combined fitment and internal support handle piece. The bottle pouch of FIG. 13 also includes a second outer loop or sleeve 627 attached to the periphery of the flexible pouch body 605 and positioned above the handle region 612. The inner support handle piece 620 also extends into the second outer sleeve or loop 627 in order to further secure it to the flexible pouch body 605 and also external to where the contents of the pouch 600 are stored. The two outer sleeves or loops 625, 627 secure the inner support handle piece 620 to the bottle pouch 600, which serves to reinforce and provide rigidity to top area of the bottle pouch 600. Alternatively, the bottle pouch of FIG. 13 may also include an additional one, two, or three outer sleeves or loops coupled to the outer periphery of the flexible pouch body 605 above the handle region 612 for further securing the inner support handle piece 620 to the flexible pouch body 605 of the bottle pouch 600. The need for and the number and length of the additional outer sleeves or loops 625,627 above the handle region 612 will be dependent on the length of the inner support handle piece 620 and the size of the pouch 600. The combined fitment 610 and inner support handle piece 620 also includes a rigid handle portion 630 (also referred to as an outer support handle piece) extending from the inner support handle piece 620 that forms the rigid handle of the bottle pouch 600. The rigid handle portion 630 is preferably a single outer support handle piece that extends linearly from and is unitary with the inner support handle piece, but may optionally include a second outer support handle piece 630*a* extending from the inner support handle piece 620. When the rigid handle portion includes a second outer support handle piece, the first and second outer support handle pieces propagate from the end of the inner support handle piece in a "Y" shape configuration to allow the user to grasp two closely positioned rigid handle portions, which may be advantageous for large and heavy bottle pouches.

Again referring to FIG. 13, the inner support handle piece 620 passes from the inside of the second outer sleeve or loop 627 of the bottle pouch 600 to the outside of the bottle pouch 600 proximate or adjacent to the handle region 612 to become an outer support handle piece or rigid handle portion 630. The rigid handle portion or outer support handle piece 630 functions as a handle for the bottle pouch 600 and reinforces the handle region 612 of the bottle pouch 600 and allows for ease of handling the bottle pouch 600 while dispensing contents (not shown) inside the flexible pouch body 605 through the fitment 610 to the outside of the bottle pouch 600. The bottle pouch 600 of FIG. 13 also includes an additional outer sleeve or loop 635 for securing the end 640 of the rigid handle portion or outer support handle piece 630 to the periphery of the flexible pouch body 605 below the handle region 612 of the bottle pouch 600 in order to provide added stability and rigidity to the bottle pouch while dispensing its contents. The bottle pouch 600 of FIG. 13 with the additional outer sleeve or loop 635 below the handle region 612 may optionally also include an additional one, two, or three additional outer sleeves or loops coupled to the outer periphery of the flexible pouch body below the handle region 612 for further securing the end of the rigid handle portion or outer support handle piece 630 to the periphery of the flexible pouch body 605 of the bottle pouch 600. The need for and the number and length of the additional outer sleeves or loops 635 below the handle region 612 will be dependent on the length of the rigid handle portion 630.

The handle region (also referred to as outer support handle piece) 530, 630 of the flexible pouch body of the various embodiments and described and depicted herein may take various shapes, including, but not limited to circular, oval, rectangular, square, triangular, as well as irregular contoured shaped for allowing the user of the pouch to easily and efficiently grasp the rigid handle portion 530, 630 located adjacent to the handle region 512, 612. The integral inner support handle piece and outer support handle piece are preferably of a cylindrical shape with an outer diameter ranging from 0.5 to 23 mm, or 3 to 18 mm, or 8 to 13 mm.

The pouches with internal supports disclosed herein provide improved stability and control when pouring or dispensing relative to prior art pouches because of having the internal supports coupled to the fitment or spout of the pouch. This feature is not provided by prior art pouches. Even prior art pouches with a handle or other rigid support not coupled to the fitment or spout still lack stability and control during dispensing. The internal rigid support feature coupled to the fitment of the pouches of the present disclosure provide such improved stability and control during dispensing. Additionally, the pouches with internal supports disclosed herein provide support to the flexible pouch body material even when the contents of the pouch are mostly depleted or very light. Prior art pouches without internal supports will collapse or flop without such support, which makes dispensing more difficult as the pouch contents are emptied.

In accordance with one or more aspects of a first disclosed embodiment, a pouch with internal support comprises: a flexible pouch including a fitment coupled to a flexible pouch body and at least one inner support piece coupled to the fitment and extending into the inside of the pouch through the interior of the fitment, wherein said fitment includes a fitment inner engagement feature, wherein the at least one inner support piece includes an inner support engagement feature and at least one inner support extending from the inner support engagement feature, and wherein the fitment inner engagement feature and inner support engagement feature are interlocked.

In accordance with another aspect of the disclosed embodiment, the at least one inner support functions as a handle.

In accordance with another aspect of the disclosed embodiment, the at least one inner support functioning as a handle passes from the inside of the pouch to the outside of the pouch.

In accordance with another aspect of the disclosed embodiment, the at least one inner support functioning as a handle passing from the inside of the pouch to the outside of the pouch passes back into the inside of the pouch.

In accordance with another aspect of the disclosed embodiment, the at least one inner support functions as an edge support.

In accordance with another aspect of the disclosed embodiment, the at least one inner support piece includes two supports.

In accordance with another aspect of the disclosed embodiment, the two supports function as a handle.

In accordance with another aspect of the disclosed embodiment, the two supports function as a handle and as an edge support.

In accordance with another aspect of the disclosed embodiment, the at least one inner support piece includes three supports.

In accordance with another aspect of the disclosed embodiment, two supports function as a handle and one support functions as an edge support.

In accordance with another aspect of the disclosed embodiment, one supports functions as a handle and two supports function as a side support.

In accordance with another aspect of the disclosed embodiment, the fitment is annular, oval or rectangular in shape.

In accordance with another aspect of the disclosed embodiment, the fitment is a semi-rigid, flexible or elastic material.

In accordance with another aspect of the disclosed embodiment, the fitment material is selected from the group consisting of metal, glass, ceramic, wood, polypropylene, polystyrene, polyester, nylon, polyethylene, polyhydroxyalkanoate, polylactic acid, polyester from sugar cane or corn derived ethanol and molded pulp.

In accordance with another aspect of the disclosed embodiment, the interlocked fitment inner engagement feature and inner support engagement feature keep the at least one inner support piece from falling into and out of the flexible pouch body.

In accordance with another aspect of the disclosed embodiment, the fitment inner engagement feature is substantially ring shaped.

In accordance with another aspect of the disclosed embodiment, the fitment inner engagement feature is selected from the group the consisting of a lip, a groove, a tongue, a tooth, a channel, a ridge, a clip, and a clasp.

In accordance with another aspect of the disclosed embodiment, the inner support engagement feature is substantially ring shaped.

In accordance with another aspect of the disclosed embodiment, the inner support engagement feature is selected from the group the consisting of a lip, a groove, a tongue, a tooth, a channel, a ridge, a clip, and a clasp.

In accordance with another aspect of the disclosed embodiment, the fitment inner engagement feature is integral to the inside diameter of the fitment or a separate piece press/friction fit into the inside diameter of the fitment.

In accordance with another aspect of the disclosed embodiment, the at least one inner support piece is a semi-rigid, flexible or elastic material that is equal to or greater in stiffness relative to the flexible pouch body.

In accordance with another aspect of the disclosed embodiment, the at least one inner support piece material is selected from the group consisting of metal, glass, ceramic, wood, polypropylene, polystyrene, polyester, nylon, polyethylene, polyhydroxyalkanoate, polylactic acid, polyester from sugar cane or corn derived ethanol and molded pulp.

In accordance with another aspect of the disclosed embodiment, further including a cap or a dispensing mechanism 611 (see FIG. 13) interconnected to the fitment.

In accordance with another aspect of the disclosed embodiment, the cap or the dispensing mechanism is interconnected to the fitment via a screw-on system, a hinged system or a mechanical coupling system.

In accordance with another aspect of the disclosed embodiment, the dispensing mechanism is selected from the group consisting of a trigger sprayer, a pump, a valve, a push pull spout, a pour back spout, and dispensing ball or bulb for dosing.

In accordance with another aspect of the disclosed embodiment, the flexible pouch body is in the shape of a bottle, jug, a bottle or a tube.

In accordance with another aspect of the disclosed embodiment, the flexible pouch body further includes a liquid, a dry solid, a powdered solid or combinations thereof.

In accordance with another aspect of the disclosed embodiment, the flexible pouch body is coupled to the fitment via a heat seal, an ultrasonic seal or an adhesive seal.

In accordance with another aspect of the disclosed embodiment, the at least one inner support is in a compressed or compacted state prior to being inserted into the flexible pouch body.

In accordance with another aspect of the disclosed embodiment, the at least one inner support in a compressed or compacted state includes springs, tension or a combination thereof.

In accordance with another aspect of the disclosed embodiment, the at least one inner support in a compressed or compacted state expands to conform to the volume of the pouch after being inserted into the flexible pouch body.

In accordance with another aspect of the disclosed embodiment, the at least one inner support piece reinforces at least one portion of the flexible pouch body selected from the group consisting of a handle, a side wall, a side edge, a bottom edge, a top edge, a bottom wall, and combinations thereof.

In accordance with one or more aspects of a second disclosed embodiment, a pouch with an integrated fitment and handle piece comprises: a flexible pouch including a combined fitment and handle piece coupled to a flexible pouch body, wherein the combined fitment and handle piece includes a handle portion extending from the combined fitment and handle piece, and wherein the combined fitment and handle piece are unitary.

In accordance with another aspect of the second disclosed embodiment, the handle portion is in the interior of the pouch.

In accordance with another aspect of the second disclosed embodiment, the handle portion interior to the pouch passes from the interior of the pouch to the exterior of the pouch.

In accordance with another aspect of the second disclosed embodiment, the handle portion interior to the pouch passing from the interior of the pouch to the exterior of the pouch passes back into the interior of the pouch.

In accordance with another aspect of the second disclosed embodiment, the handle portion is exterior of the pouch.

In accordance with another aspect of the second disclosed embodiment, the combined fitment and handle piece are coupled to the flexible pouch body via an adhesive seal, an ultrasonic seal or a heat seal.

In accordance with another aspect of the second disclosed embodiment, the combined fitment and handle piece is a semi-rigid, flexible or elastic material that is equal to or greater in stiffness relative to the flexible pouch body.

In accordance with another aspect of the second disclosed embodiment, the combined fitment and handle piece material is selected from the group consisting of metal, glass, ceramic, wood, polypropylene, polystyrene, polyester, nylon, polyethylene, polyhydroxyalkanoate, polylactic acid, polyester from sugar cane or corn derived ethanol and molded pulp.

In accordance with another aspect of the second disclosed embodiment, the combined fitment and handle piece reinforces a handle or provides a handle to the flexible pouch body.

In accordance with one or more aspects of a third disclosed embodiment, a pouch with an integrated fitment and inner support piece comprises: a flexible pouch including a combined fitment and inner support piece coupled to a flexible pouch body, wherein the combined fitment and inner support piece includes at least one inner support extending from the combined fitment and inner support piece, and wherein the combined fitment and inner support piece are unitary.

In accordance with another aspect of the third disclosed embodiment, the at least one inner support is in the interior of the pouch.

In accordance with another aspect of the third disclosed embodiment, the combined fitment and inner support piece are coupled to the flexible pouch body via an adhesive seal, an ultrasonic seal, or a heat seal.

In accordance with another aspect of the third disclosed embodiment, the combined fitment and inner support piece is a semi-rigid, flexible or elastic material that is equal to or greater in stiffness relative to the flexible pouch body.

In accordance with another aspect of the third disclosed embodiment, the combined fitment and inner support piece material is selected from the group consisting of metal, glass, ceramic, wood, polypropylene, polystyrene, polyester, nylon, polyethylene, polyhydroxyalkanoate, polylactic acid, polyester from sugar cane or corn derived ethanol and molded pulp.

In accordance with another aspect of the third disclosed embodiment, the at least one inner support is in a compressed or compacted state prior to being inserted into the flexible pouch body.

In accordance with another aspect of the third disclosed embodiment, the at least one inner support in a compressed or compacted state includes springs, or tension, or combinations thereof.

In accordance with another aspect of the third disclosed embodiment, the at least one inner support in a compressed or compacted state expands to conform to the volume of the pouch after being inserted into the flexible pouch body.

In accordance with another aspect of the third disclosed embodiment, the combined fitment and inner support piece reinforces at least one portion of the flexible pouch body selected from the group consisting of a handle, a side wall, a side edge, a bottom edge, a top edge, a bottom wall and combinations thereof.

In accordance with one or more aspects of a fourth disclosed embodiment, a method of making a pouch with an internal support comprises: i) providing a flexible pouch including a fitment coupled to a flexible pouch body and at least one inner support piece, wherein said fitment includes a fitment inner engagement feature, and wherein the at least one inner support piece includes an inner support engagement feature and at least one inner support extending from the inner support engagement feature; and ii) sliding the inner support piece into the fitment such that the fitment inner engagement feature and the inner support engagement feature interlock to keep the at least one inner support piece from falling into and out of the flexible pouch body.

In accordance with another aspect of the fourth disclosed embodiment, further comprising providing a cap or a dispensing mechanism and interconnecting the cap or the dispensing mechanism to the fitment via a screw-on system, a hinged system or a mechanical coupling system.

In accordance with another aspect of the fourth disclosed embodiment, the dispensing mechanism is selected from the group consisting of a trigger sprayer, a pump, a valve, a push pull spout, a pour back spout, and dispensing ball or bulb for dosing.

In accordance with another aspect of the fourth disclosed embodiment, further including filling the flexible pouch body with a liquid, a dry solid, a powdered solid or combinations thereof.

In accordance with another aspect of the fourth disclosed embodiment, the at least one inner support is in a compressed or compacted state prior to being slid into the fitment.

In accordance with another aspect of the fourth disclosed embodiment, the at least one inner support in a compressed or compacted state includes springs, or tension, or a combination thereof.

In accordance with another aspect of the fourth disclosed embodiment, further including expanding the at least one inner support in a compressed or compacted state to conform to the volume of the pouch after being slid into the fitment.

In accordance with another aspect of the fourth disclosed embodiment, the at least one inner support piece reinforces at least one portion of the flexible pouch body selected from the group consisting of a handle, a side wall, a side edge, a bottom edge, a top edge, a bottom wall, and combinations thereof.

In accordance with another aspect of the fourth disclosed embodiment, the at least one inner support functions as a handle.

In accordance with another aspect of the fourth disclosed embodiment, the at least one inner support functioning as a handle passes from the inside of the pouch to the outside of the pouch.

In accordance with another aspect of the fourth disclosed embodiment, the at least one inner support functioning as a handle passing from the inside of the pouch to the outside of the pouch passes back into the inside of the pouch.

In accordance with another aspect of the fourth disclosed embodiment, the at least one inner support functions as an edge support.

In accordance with another aspect of the fourth disclosed embodiment, the at least one inner support piece includes two supports.

In accordance with another aspect of the fourth disclosed embodiment, the two supports function as a handle.

In accordance with another aspect of the fourth disclosed embodiment, the two supports function as a handle and as an edge support.

In accordance with another aspect of the fourth disclosed embodiment, the at least one inner support piece includes three supports.

In accordance with another aspect of the fourth disclosed embodiment, two supports function as a handle and one support functions as an edge support.

In accordance with another aspect of the fourth disclosed embodiment, one supports functions as a handle and two supports function as a side support.

In accordance with another aspect of the fourth disclosed embodiment, the fitment is annular, oval or rectangular in shape.

In accordance with another aspect of the fourth disclosed embodiment, the fitment is a semi-rigid, flexible or elastic material.

In accordance with another aspect of the fourth disclosed embodiment, the fitment material is selected from the group consisting of metal, glass, ceramic, wood, polypropylene, polystyrene, polyester, nylon, polyethylene, polyhydroxyalkanoate, polylactic acid, polyester from sugar cane or corn derived ethanol and molded pulp.

In accordance with another aspect of the fourth disclosed embodiment, the fitment inner engagement feature is substantially ring shaped.

In accordance with another aspect of the fourth disclosed embodiment, the fitment inner engagement feature is selected from the group the consisting of a lip, a groove, a tongue, a tooth, a channel, a ridge, a clip, and a clasp.

In accordance with another aspect of the fourth disclosed embodiment, the inner support engagement feature is substantially ring shaped.

In accordance with another aspect of the fourth disclosed embodiment, the inner support engagement feature is selected from the group the consisting of a lip, a groove, a tongue, a tooth, a channel, a ridge, a clip, and a clasp.

In accordance with another aspect of the fourth disclosed embodiment, the fitment inner engagement feature is integral to the inside diameter of the fitment or a separate piece press/friction fit into the inside diameter of the fitment.

In accordance with another aspect of the fourth disclosed embodiment, the at least one inner support piece is a semi-rigid, flexible or elastic material that is equal to or greater in stiffness relative to the flexible pouch body.

In accordance with another aspect of the fourth disclosed embodiment, the at least one inner support piece material is selected from the group consisting of metal, glass, ceramic, wood, polypropylene, polystyrene, polyester, nylon, polyethylene, polyhydroxyalkanoate, polylactic acid, polyester from sugar cane or corn derived ethanol and molded pulp.

In accordance with another aspect of the fourth disclosed embodiment, the flexible pouch body is coupled to the fitment via a heat seal, an ultrasonic seal or an adhesive seal.

In yet another aspect of the disclosed embodiment, a pouch is disclosed. The pouch having a fitment comprising an inner engagement feature configured to couple with a handle engagement feature, a handle piece substantially comprising of a handle portion and a handle engagement feature, a pouch body formed by a flexible film material sealed substantially about the fitment, and a support insert. The handle piece is substantially passed through the interior of the fitment such that the inner engagement feature is coupled with the handle engagement feature and wherein the handle portion extends through the bottom of the fitment. The support insert is arranged within the pouch to maintain a shape within.

In accordance with one or more aspects of a fifth disclosed embodiment, a bottle pouch with an integrated fitment and inner support handle piece comprises: a flexible pouch in the shape of a bottle comprising a flexible pouch body with a handle region and a combined fitment and inner support handle piece including a rigid handle portion extending from the combined fitment and inner support handle piece, wherein the combined fitment and inner support handle piece is coupled to the flexible pouch, wherein the inner support handle piece extends from the inside of the fitment and is internal to the flexible pouch body, and wherein the inner support handle piece passes from the interior of the flexible pouch body to the exterior of the flexible pouch body adjacent to the handle region of the flexible pouch body to form the rigid handle portion that increases the rigidity of the handle region of the flexible pouch.

In accordance with another aspect of the fifth disclosed embodiment, the inner support handle piece passes from the exterior of the flexible pouch body back into the interior of the flexible pouch body adjacent to the handle region of the flexible pouch body.

In accordance with another aspect of the fifth disclosed embodiment, the combined fitment and inner support handle piece are unitary.

In accordance with another aspect of the fifth disclosed embodiment, the combined fitment and inner support handle piece are formed in an injection molding process.

In accordance with another aspect of the fifth disclosed embodiment, the combined fitment and inner support handle piece include a fitment inner engagement feature and an inner support handle piece engagement feature for interlocking the fitment to the inner support handle piece.

In accordance with another aspect of the fifth disclosed embodiment, the rigid handle portion includes one outer support handle piece for the handle region.

In accordance with another aspect of the fifth disclosed embodiment, the rigid handle portion includes a second outer support handle piece for the handle region.

In accordance with another aspect of the fifth disclosed embodiment, the combined fitment and inner support handle piece are coupled to the flexible pouch body via an adhesive seal, an ultrasonic seal or a heat seal.

In accordance with another aspect of the fifth disclosed embodiment, the combined fitment and inner support handle piece is a rigid material that is greater in stiffness relative to the flexible pouch body.

In accordance with another aspect of the fifth disclosed embodiment, the rigid material is selected from the group consisting of metal, glass, ceramic, wood, polypropylene, polystyrene, polyester, nylon, polyethylene, polyhydroxyalkanoate, polylactic acid, polyester from sugar cane or corn derived ethanol and molded pulp.

In accordance with another aspect of the fifth disclosed embodiment, further including a cap or a dispensing mechanism interconnected to the fitment.

In accordance with another aspect of the fifth disclosed embodiment, the cap or the dispensing mechanism is interconnected to the fitment via a screw-on system, a hinged system or a mechanical coupling system.

In accordance with another aspect of the fifth disclosed embodiment, the dispensing mechanism is selected from the group consisting of a trigger sprayer, a pump, a valve, a push pull spout, a pour back spout, and dispensing ball or bulb for dosing.

In accordance with another aspect of the fifth disclosed embodiment, the flexible pouch body further includes a liquid, a dry solid, a powdered solid or combinations thereof.

In accordance with another aspect of the fifth disclosed embodiment, the fitment is annular, oval or rectangular in shape.

In accordance with another aspect of the fifth disclosed embodiment, the fitment is a semi-rigid, flexible or elastic material.

In accordance with another aspect of the fifth disclosed embodiment, the fitment material is selected from the group consisting of metal, glass, ceramic, wood, polypropylene, polystyrene, polyester, nylon, polyethylene, polyhydroxyalkanoate, polylactic acid, polyester from sugar cane or corn derived ethanol and molded pulp.

In accordance with one or more aspects of a sixth disclosed embodiment, a bottle pouch with an integrated fitment and inner support handle piece comprises: a flexible pouch in the shape of a bottle comprising a flexible pouch body with a handle region and at least one outer sleeve or loop coupled to an outer periphery of the flexible pouch body, a combined fitment and inner support handle piece including a rigid handle portion extending from the combined fitment and inner support handle piece, wherein the combined fitment and inner support handle piece is coupled to the flexible pouch and the inner support handle piece passes through the interior of the at least one outer sleeve or loop, wherein the inner support handle piece extends from the outer periphery of the fitment and is external to the flexible pouch body, and wherein the inner support handle piece passes from the interior of the outer sleeve or loop to the exterior of the flexible pouch body adjacent to the handle region of the flexible pouch body to form the rigid handle portion that increases the rigidity of the handle region of the flexible pouch.

In accordance with another aspect of the sixth disclosed embodiment, further including a second outer sleeve or loop coupled to the outer periphery of the flexible pouch body.

In accordance with another aspect of the sixth disclosed embodiment, the inner support handle piece passes through the interior of the second outer sleeve or loop.

In accordance with another aspect of the sixth disclosed embodiment, the rigid handle portion passes through the interior of the second outer sleeve or loop located adjacent to the handle region.

In accordance with another aspect of the sixth disclosed embodiment, further including a third outer sleeve or loop coupled to the outer periphery of the flexible pouch body.

In accordance with another aspect of the sixth disclosed embodiment, the inner support handle piece passes through the interior of the third outer sleeve or loop.

In accordance with another aspect of the sixth disclosed embodiment, the rigid handle portion passes through the interior of the third outer sleeve or loop located adjacent to the handle region.

In accordance with another aspect of the sixth disclosed embodiment, the at least one outer sleeve or loop ranges from 5 mm to 250 mm in length.

In accordance with another aspect of the sixth disclosed embodiment, the at least one outer sleeve or loop ranges from 5 mm to 25 mm in inside diameter.

In accordance with another aspect of the sixth disclosed embodiment, the outside diameter of the inner support handle piece and the rigid handle portion is from 3 to 23 mm.

In accordance with another aspect of the sixth disclosed embodiment, the combined fitment and inner support handle piece are unitary.

In accordance with another aspect of the sixth disclosed embodiment, the combined fitment and inner support handle piece include an inner support handle piece with a slip ring at an end of the inner support handle piece that slides over an annular shoulder of the fitment in a press fit type of arrangement.

In accordance with another aspect of the sixth disclosed embodiment, the rigid handle portion includes one outer support handle piece for the handle region.

In accordance with another aspect of the sixth disclosed embodiment, the rigid handle portion includes a second outer support handle piece for the handle region.

In accordance with another aspect of the sixth disclosed embodiment, the combined fitment and inner support handle piece are coupled to the flexible pouch body via an adhesive seal, an ultrasonic seal or a heat seal.

In accordance with another aspect of the sixth disclosed embodiment, the combined fitment and inner support handle piece is a rigid material that is greater in stiffness relative to the flexible pouch body.

In accordance with another aspect of the sixth disclosed embodiment, the rigid material is selected from the group consisting of metal, glass, ceramic, wood, polypropylene, polystyrene, polyester, nylon, polyethylene, polyhydroxyalkanoate, polylactic acid, polyester from sugar cane or corn derived ethanol and molded pulp.

In accordance with another aspect of the sixth disclosed embodiment, further including a cap or a dispensing mechanism interconnected to the fitment.

In accordance with another aspect of the sixth disclosed embodiment, the cap or the dispensing mechanism is interconnected to the fitment via a screw-on system, a hinged system or a mechanical coupling system.

In accordance with another aspect of the sixth disclosed embodiment, the dispensing mechanism is selected from the group consisting of a trigger sprayer, a pump, a valve, a push pull spout, a pour back spout, and dispensing ball or bulb for dosing.

In accordance with another aspect of the sixth disclosed embodiment, the flexible pouch body further includes a liquid, a dry solid, a powdered solid or combinations thereof.

In accordance with another aspect of the sixth disclosed embodiment, the fitment is annular, oval or rectangular in shape.

In accordance with another aspect of the sixth disclosed embodiment, the fitment is a semi-rigid, flexible or elastic material.

In accordance with another aspect of the sixth disclosed embodiment, the fitment material is selected from the group consisting of metal, glass, ceramic, wood, polypropylene, polystyrene, polyester, nylon, polyethylene, polyhydroxyalkanoate, polylactic acid, polyester from sugar cane or corn derived ethanol and molded pulp.

In accordance with one or more aspects of a seventh disclosed embodiment, a method of making a bottle pouch with an integrated fitment and inner support handle piece comprises: providing a flexible pouch in the shape of a bottle comprising i) a flexible pouch body with a handle region, and ii) a combined fitment and inner support handle piece including a rigid handle portion extending from the combined fitment and inner support handle piece, coupling the combined fitment and inner support handle piece to the flexible pouch, wherein the inner support handle piece extends from the inside of the fitment and is internal to the flexible pouch body, and passing the inner support handle piece from the interior of the flexible pouch body to the exterior of the flexible pouch body adjacent to the handle region of the flexible pouch body to form the rigid handle portion that increases the rigidity of the handle region of the flexible pouch.

In accordance with one or more aspects of a eighth disclosed embodiment, a method of making a bottle pouch with an integrated fitment and inner support handle piece comprises: providing a flexible pouch in the shape of a bottle comprising i) a flexible pouch body with a handle region and at least one outer sleeve or loop coupled to an outer periphery of the flexible pouch body, and ii) a combined fitment and inner support handle piece including a rigid handle portion extending from the combined fitment and inner support handle piece, wherein the inner support handle piece extends from the outer periphery of the fitment, coupling the combined fitment and inner support handle piece to the flexible pouch, passing the inner support handle piece through the interior of the at least one outer sleeve or loop and is external to the flexible pouch body, and passing the inner support handle piece from the interior of the outer sleeve or loop to the exterior of the flexible pouch body adjacent to the handle region of the flexible pouch body to form the rigid handle portion that increases the rigidity of the handle region of the flexible pouch.

It should be understood that the foregoing description is only illustrative of the aspects of the disclosed embodiment and that the aspects of the disclosed embodiment can be used individually or in any suitable combination thereof. Various alternatives and modifications can be devised by those skilled in the art without departing from the aspects of the disclosed embodiment. Accordingly, the aspects of the disclosed embodiment are intended to embrace all such alternatives, modifications and variances that fall within the scope of the appended claims. Further, the mere fact that different features are recited in mutually different dependent or independent claims does not indicate that a combination of these features cannot be advantageously used, such a combination remaining within the scope of the aspects of the invention.

All patents, test procedures, and other documents cited herein, including priority documents, are fully incorporated by reference to the extent such disclosure is not inconsistent with this invention and for all jurisdictions in which such incorporation is permitted. When numerical lower limits and numerical upper limits are listed herein, ranges from any lower limit to any upper limit are contemplated.

What is claimed is:

1. A bottle pouch with an integrated fitment and inner support handle piece comprising:

a flexible pouch in the shape of a bottle comprising a flexible pouch body with a handle region and at least one outer sleeve or loop coupled to an outer periphery of the flexible pouch body, the at least one outer sleeve or loop including a first outer sleeve or loop, the first outer sleeve or loop having a first open end, a second open end opposite the first open end, and an interior extending between the first open end and the second open end, a combined fitment and inner support handle piece comprising a fitment portion and an inner support handle piece portion, the inner support handle piece portion having a proximal end adjacent and attached to the fitment portion and a distal end opposite the proximal end, a rigid handle portion extending from the distal end of the inner support handle piece portion, wherein the combined fitment and inner support handle piece is coupled to the flexible pouch and the inner support handle piece portion is received through the first open end and passes through the interior of the first outer sleeve or loop, wherein the inner support handle piece portion extends from an outer periphery of the fitment and the entire inner support handle piece portion is external to the flexible pouch body, and wherein the inner support handle piece portion passes from the interior of the first outer sleeve or loop through the second open end to an exterior of the first outer sleeve or loop and to an exterior of the flexible pouch body adjacent to the handle region of the flexible pouch body to form the rigid handle portion that increases the rigidity of the handle region of the flexible pouch.

2. The bottle pouch of claim 1 further including a second outer sleeve or loop coupled to the outer periphery of the flexible pouch body.

3. The bottle pouch of claim 2 wherein the inner support handle piece portion passes through an interior of the second outer sleeve or loop.

4. The bottle pouch of claim 2 wherein the rigid handle portion passes through an interior of the second outer sleeve or loop located adjacent to the handle region.

5. The bottle pouch of claim 2 further including a third outer sleeve or loop coupled to the outer periphery of the flexible pouch body.

6. The bottle pouch of claim 5 wherein the inner support handle piece portion passes through an interior of the third outer sleeve or loop.

7. The bottle pouch of claim 5 wherein the rigid handle portion passes through an interior of the third outer sleeve or loop located adjacent to the handle region.

8. The bottle pouch of claim 1 wherein the first outer sleeve or loop ranges from 5 mm to 250 mm in length.

9. The bottle pouch of claim 1 wherein the first outer sleeve or loop ranges from 5 mm to 25 mm in inside diameter.

10. The bottle pouch of claim 1 wherein the inner support handle piece portion and the rigid handle portion have an outside diameter in the range of from 3 mm to 23 mm.

11. The bottle pouch of claim 1, wherein the combined fitment and inner support handle piece are of a unitary construction forming one contiguous piece.

12. The bottle pouch of claim 1, wherein the combined fitment and inner support handle piece includes a slip ring at the proximal end of the inner support handle piece portion that slides over an annular shoulder of the fitment portion in a press fit type of arrangement.

13. The bottle pouch of claim 1, wherein the rigid handle portion includes one outer support handle piece for the handle region.

14. The bottle pouch of claim 13, wherein the rigid handle portion includes a second outer support handle piece for the handle region.

15. The bottle pouch of claim 1, wherein the combined fitment and inner support handle piece are coupled to the flexible pouch body via an adhesive seal, an ultrasonic seal or a heat seal.

16. The bottle pouch of claim 1, wherein the combined fitment and inner support handle piece is a rigid material that is greater in stiffness relative to the flexible pouch body.

17. The bottle pouch of claim 16, wherein the rigid material is selected from the group consisting of metal, glass, ceramic, wood, polypropylene, polystyrene, polyester, nylon, polyethylene, polyhydroxyalkanoate, polylactic acid, polyester from sugar cane or corn derived ethanol and molded pulp.

18. The bottle pouch of claim 1 further including a cap or a dispensing mechanism interconnected to the fitment portion.

19. The bottle pouch of claim 18, wherein the cap or the dispensing mechanism is interconnected to the fitment portion via a screw-on system, a hinged system or a mechanical coupling system.

20. The bottle pouch of claim 18, wherein the dispensing mechanism is selected from the group consisting of a trigger sprayer, a pump, a valve, a push pull spout, a pour back spout, and dispensing ball or bulb for dosing.

21. The bottle pouch of claim 1, wherein the flexible pouch body further includes a liquid, a dry solid, a powdered solid or combinations thereof.

22. The bottle pouch of claim 1, wherein the fitment portion is annular, oval or rectangular in shape.

23. The bottle pouch of claim 1, wherein the fitment portion is a semi-rigid, flexible or elastic material.

24. The bottle pouch of claim 23, wherein the material is selected from the group consisting of metal, glass, ceramic, wood, polypropylene, polystyrene, polyester, nylon, polyethylene, polyhydroxyalkanoate, polylactic acid, polyester from sugar cane or corn derived ethanol and molded pulp.

25. The bottle pouch of claim 1 further including a second outer sleeve or loop coupled to the outer periphery of the flexible pouch body, wherein the second outer sleeve or loop extends between a third open end and a fourth open end opposite the third open end.

26. A method of making a bottle pouch with an integrated fitment and inner support handle piece comprising:

providing a flexible pouch in the shape of a bottle comprising i) a flexible pouch body with a handle region and at least one outer sleeve or loop coupled to an outer periphery of the flexible pouch body, the at least one outer sleeve or loop including a first outer sleeve or loop, the first outer sleeve or loop having a first open end, a second open end opposite the first open end, and an interior extending between the first open end and the second open end, ii) a combined fitment and inner support handle piece comprising a fitment portion and an inner support handle piece portion, the inner support handle piece portion having a proximal end adjacent and attached directly to the fitment portion and a distal end opposite the proximal end; and iii) a rigid handle portion extending from the distal end of the inner support handle piece portion, wherein the inner support handle piece portion extends from the outer periphery of the fitment portion, coupling the combined fitment and inner support handle piece to the flexible pouch, passing the inner support handle piece portion through the first open end and through the interior of the first outer sleeve or loop wherein the entire inner support handle piece is external to the flexible pouch body, and passing the inner support handle piece portion from the interior of the first outer sleeve or loop through the second open end to an exterior of the first outer sleeve or loop and to an exterior of the flexible pouch body adjacent to the handle region of the flexible pouch body to form the rigid handle portion that increases the rigidity of the handle region of the flexible pouch.

* * * * *